US005380043A

United States Patent [19]

Schwartz

[11] Patent Number: 5,380,043

[45] Date of Patent: * Jan. 10, 1995

[54] HYPERTEXT BOOK ATTACHMENT

[75] Inventor: David C. Schwartz, Southborough, Mass.

[73] Assignee: Productive Environments, Framingham, Mass.

[ * ] Notice: The portion of the term of this patent subsequent to Sep. 17, 2008 has been disclaimed.

[21] Appl. No.: 324,417

[22] Filed: Mar. 16, 1989

[51] Int. Cl.[6] ..... B42D 1/00; B42D 3/00

[52] U.S. Cl. ..... 281/15.1; 281/5; 281/16; 281/42; 281/43; 281/29; 281/47; 281/51; 402/80 R; 402/4; 402/70; 402/78

[58] Field of Search ..... 281/15.1, 16, 51, 29, 281/3, 5, 19, 42, 43, 47; 402/4, 70, 73, 76, 78, 80 R

[56] References Cited

U.S. PATENT DOCUMENTS

| | | | |
|---|---|---|---|
| 229,046 | 6/1880 | Low . | |
| 383,543 | 5/1888 | Rigby . | |
| 392,066 | 10/1888 | Razall . | |
| 408,260 | 8/1889 | Pratt . | |
| 432,700 | 7/1890 | Gregg . | |
| 724,849 | 4/1903 | Gresham . | |
| 1,193,590 | 8/1916 | Napp . | |
| 1,256,868 | 2/1918 | Bergendahl . | |
| 1,316,039 | 9/1919 | James . | |
| 1,469,163 | 9/1923 | Mallina . | |
| 1,736,384 | 11/1929 | Wright | 150/35 |
| 1,778,766 | 10/1930 | McMichael . | |
| 1,810,440 | 6/1931 | Shedd . | |
| 1,891,376 | 12/1932 | Furlong . | |
| 1,913,818 | 6/1933 | Petrick . | |
| 2,190,438 | 2/1940 | Vogt | 28/5 X |
| 2,270,015 | 1/1942 | Wright | 150/35 |
| 2,278,143 | 3/1942 | Matthews | 45/61 |
| 2,283,584 | 5/1942 | Sloan | 281/16 |
| 2,431,472 | 11/1947 | Fistell | 150/39 |
| 2,467,656 | 4/1949 | Broughton | 281/19 |
| 2,490,147 | 12/1949 | Minton | 281/43 |
| 2,541,735 | 2/1951 | Albrecht, Jr. | 281/42 |
| 2,687,313 | 8/1954 | Pisano | 281/42 |
| 2,848,163 | 8/1958 | Serrell | 235/61.12 |
| 2,909,202 | 10/1959 | Rock | 150/35 |
| 3,016,036 | 1/1962 | Jorgensen | 116/119 |
| 3,071,395 | 1/1963 | Essman | 281/42 |
| 3,565,462 | 2/1971 | Gottlieb | 281/3 |
| 3,737,178 | 6/1973 | Tjernlund et al. | 281/42 |
| 3,883,971 | 5/1975 | Weiss | 40/119 |
| 4,138,143 | 2/1979 | Lawes | 281/47 |
| 4,294,029 | 10/1981 | Holson | 40/388 |
| 4,350,195 | 9/1982 | Viesturs et al. | 150/39 |
| 4,420,271 | 12/1983 | Zabielski | 402/80 L |
| 4,479,733 | 10/1984 | Segal | 402/79 |
| 4,706,396 | 11/1987 | Nomura | 40/124.2 |
| 4,794,713 | 1/1989 | Yang | 40/152.1 |
| 4,838,724 | 6/1989 | Spence, Jr. | 402/79 |
| 4,840,406 | 6/1989 | Pitts | 281/1 |
| 4,848,948 | 7/1989 | Pitts | 402/29 |
| 4,869,452 | 9/1989 | Bennett | 248/441.1 |
| 4,940,353 | 7/1990 | Osono et al. | 402/79 |
| 4,981,386 | 1/1991 | Beleckis | 402/73 |

FOREIGN PATENT DOCUMENTS

| | | |
|---|---|---|
| 53336 | 5/1912 | Austria . |
| 1181313 | 1/1985 | Canada . |
| 1022036 | 2/1953 | France . |
| 887940 | 8/1953 | Germany . |
| 57100173 | 12/1980 | Japan . |
| 20015 | 11/1909 | Norway . |
| 215159 | 2/1961 | Sweden . |
| 567314 | 9/1975 | Switzerland . |
| 7338 | of 1896 | United Kingdom . |
| 643124 | 9/1950 | United Kingdom . |
| 975183 | 11/1964 | United Kingdom . |
| 1131761 | 10/1968 | United Kingdom . |
| 1115040 | 9/1984 | U.S.S.R. . |

*Primary Examiner*—Paul A. Bell

[57] ABSTRACT

A blank book attachment having a mark and sweep leaf with a fold out feature is provided. The leaf is pivotably retained along one edge on a frame, and the frame is pivotably retained at the binding spine of the host blank book. Pulling outward on the leaf causes the leaf to extend out and beyond the pages of the book allowing the pages to turn freely. When the leaf is placed within the host book, with the book open or closed, the leaf can be turned as a page, in which case it also acts as a mark to identify a specific position in the host book. Alternatively, the leaf may be pivoted on the frame to allow the host book pages to be turned past it in either direction.

10 Claims, 22 Drawing Sheets 42
41
40a
36
35
77
73
74
5a
S
α
β
γ
45
1
2
44
43
80
21
20
22
75
76
70
72

40e
40a
30
35
22
20
73
75
76
70
72
74

FIG. 29
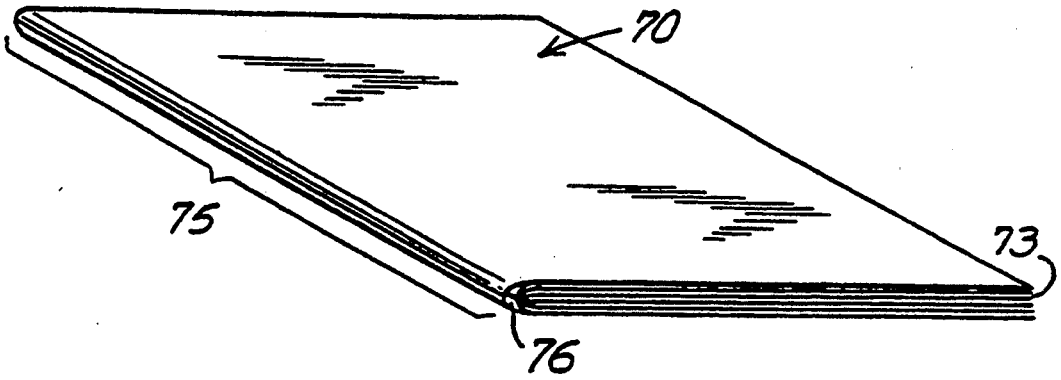
FIG. 30
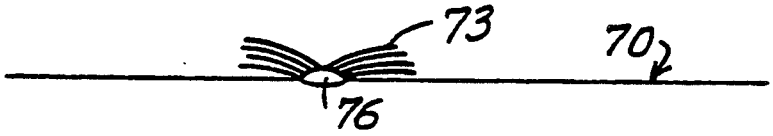
FIG. 31
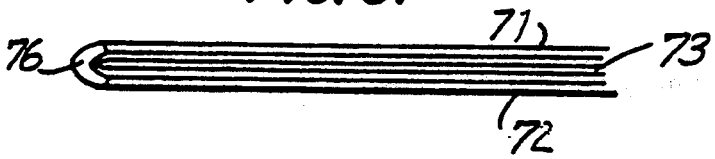
FIG. 32
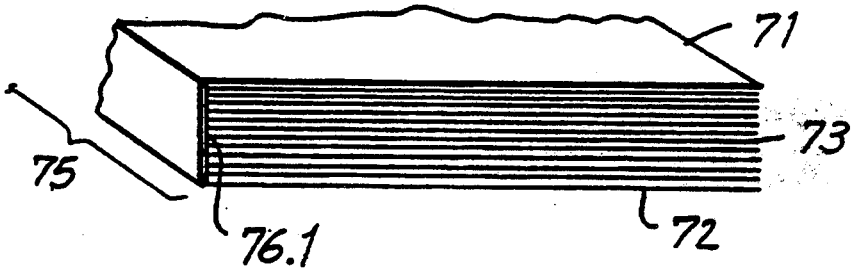
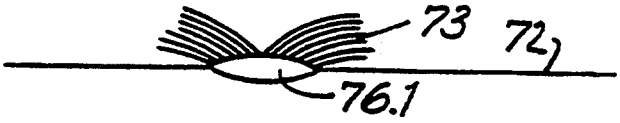
FIG. 33

HYPERTEXT BOOK ATTACHMENT

BACKGROUND OF THE INVENTION

This invention relates to "lost books" with a fixed or variable number of pages including spiral bound note books, multi-ring bound books, staple-, tape-, or glue-bound books, plastic finger clasp bound books, and the like, add-in leaves in the form of mounting surfaces with additional pages, and particularly, a repositionable mounting surface with a fold-out feature.

Host books are typically sold in a variety of forms including glue- or tape-bound with cover, staple-bound with cover, spiral-bound with cover, and ring-bound with cover. They may have a fixed or variable number of pages or no pages, and the pages may be blank pages, pages with text or pictures, where the text may be formatted or unformatted. Typically, host books with pages that are intended for writing or which contain text and or pictures in any form do not easily allow for the insertion of notes, except for use of margins, specially identified format blocks, or spaces between lines or pictures. Arbitrary notes must be taken on loose pages which themselves can be retained in the host book in a variety of ways as marks. Host pages that have pre-defined formats support structured entry of information but often do not support arbitrary input or output notes very well.

Host books have pages which are typically bound in a sequential order. If the pages can be repositioned, it requires opening of the binding and the removal and reinsertion of the pages to be repositioned. Tagging these pages or marking them for reentry requires (a) folding the page, (b) placing a loose mark in the page which could fall out, or (c) binding a mark that attaches to the page and stays on the page unless physically removed and replaced at another point. Noting or marking in this way either damages the book or covers the written material. Additionally, this type of marking does not easily allow for the continuous collection of information on the mark as the mark is moved through successive pages.

Electronic, computer-based text has been developed which can be accessed on-line via a personal computer or through a shared information utility and which addresses the issue of flexible information manipulation. The basic technology is known as hypermedia, and specifically, as it relates to textual information, hypertext. This capability provides the individual the ability to attach new information to any context he or she is working with, and to view that portion or chunk of specially tagged information out of context from its location in relation to other such specially tagged information, or in context with its location in the body of the text. In this sense, "hyper-access" means that one may view the tagged information dynamically out of context as well as in relationship to the source item or items. The mechanism provided for Viewing information on the computer is known as "multiple-windowing". This feature has proven very powerful and has opened up entirely new applications for computers in desktop publishing, computer-aided design, project management, and the like.

This capability of multiple-windowing has been unavailable to users of blank books due to the inherent limitation of physically bound surfaces and their supporting bindings.

SUMMARY OF THE INVENTION

The invention, therefore, relates to frames, leaves, additional pages for a blank book, fold-out surfaces, and particularly to book marking and more particularly to a special purpose binding that offers dymnamic book marking with a fold-out mounting surface capable of supporting additional foldable surfaces, offering a mechanical windowing capability for traditional books.

The invention is a special purpose binding which can be attached to a host book in a variety of ways, and which offers the arbitrary placement of a single surface or a set of surfaces which act as windowing surfaces, such that each independent surface positions to insert itself within the host book or alongside the host book while remaining attached to the host at all times.

The invention further relates to special bindings that offer "hyper-extending" frames that provide a mechanical analog of a hypertext system and in this manner offer the facility of a new page for a blank book that can "float" from context to context within the book and be viewed independently of any page of the book, in sequence with any page of the book, or at the same time as any page of the book, while retaining an attachment to the book.

It is the object of this invention to provide a form of "mechanical hypertext system" which provides a repositionable surface with a plurality of folding surfaces on it. The plurality of surfaces, viewed as floating pages, behave as pages of the blank book when positioned within the host book, turning as would the pages of the enclosing book. The floating surface then allows for the arbitrary collection of information in the form of notes, lists, etc. Additionally, the surface operates as a "host book mark" to allow the location of any page position in the host book. The mechanical binding offers a cluster of surfaces for the purpose of abstracting and classifying information. Additionally, it offers a means for the information to be accessed, and reused in a more flexible manner by providing a "floating" blackboard-like system that can be continually positioned and repositioned to support the state of use of the host book, while staying continually attached to the host book. In this way, a surface intensive area may be deployed, which contains a large reusable space packaged in the effective area of a page of the host book, compactly provided on a repositionable frame. The method enables the reconfiguration of folding surfaces such that they may be placed in arbitrary position with respect to one another or may be removed, substituted, or reconfigured to suit the user's end application. Thus, the mechanism allows for the continuous collection and depositing of information on its surface as it is swept through the pages of the host blank book. This enables the filtering and selection of information from the host book onto the surface, the abstracted information of which may be used in an ad hoc fashion out of the context of the original source materials, effectively offering the equivalent of hypermedia in a mechanical form of hypermedia(hypertext) surface.

Additionally, the ability to position the surfaces within the host book enables a new form of information processing where messages, typically in the form of removable adhesive notes (which may be positioned, removed and repositioned an indefinite number of times) are used in conjunction with the surfaces to allow for the rapid manipulation of classified and typed data. It is preferable for maximum usefulness of such a system that this type of message passing be accomplished within a very short time—e.g., within four seconds. The present invention supports message passing on such a time scale. A complete message passing system can thus be added to a conventional book, allowing the message passing system to operate as a complementary facility without interfering with the original application and use of the host book.

In accordance with this invention, a host book configuration could include a host book with a cover, a spine, and pages, and a frame-leaf member bound to the host book in such a way that the host book pages could turn freely and independently of the frame-leaf member, which itself could be manipulated independently of the pages. An alternative host book configuration would include as a host book a simple cover and spine, the pages of the host book comprised solely of frame-leaf members, in which case the book acts in stand-alone fashion as a mechanical hypertext system, with notes and messages passed among the pages of the book thus formed.

In accordance with the invention, a mechanical binding system is provided having a fold out leaf. The mechanical binding system has a leaf, a frame, and an adapter with means to combine frames into frame sets, as well as a means for attaching the frame to the host blank book. In the preferred embodiment, the leaf has a plurality of folding surfaces, a mounting surface, and an orientation flap. The orientation flap is connected to the back of the mounting surface leaving a free edge. The frame has an outer arm, a lateral connector arm, and an inner arm. The adapter acts as a coupler for retaining the inner arm of the frame and also functions to connect frames into frame sets as well as for attaching the frame or frame sets, as the case may be, to the host blank book.

The mounting surface of the leaf is a plane that is rectangular in shape and whose width is at most equal to the width of the frame. The orientation flap hinges to its back along a line defined by points equidistant from the parallel lateral edges of the mounting surface. The free edge of the orientation flap is pivotally hinged to the outer arm of the frame allowing it to rotate freely about the arm. The connector arm of the frame is of length at most equal to the width of the cover of the book, and greater than the widest page of the blank book, and the inner arm is of length at most equal to the length of the back or binding of the host book, such that the mounting surface and orientation flap can be positioned within or alongside the host book to the right or to the left. The adapter has a means for pivotably and removably retaining the frame and joining one or more additional frames, and has a length substantially equal to the book binding and allowing the inner arm to frictionally fit within the book binding. The adapter has a means for fixing itself to the host book in such a way that it is semi-permanently attached to the book and translationally stationary, allowing the inner arm to rotate 360° around the host book. The leaf member may be positioned within the closed book arbitrarily between any pages, or extended outward to either side of the book and placed on a work surface lying flat such that the pages of the book are in plain view with the mounting surface placed to either side of the book in plain view.

Variations on the leaf member would allow for the mounting of a plurality of folding surfaces on the mounting surface. This plurality of folding surfaces could have a variety of folded configurations and could contain various means for retaining loose pages such as envelopes, pouches and the like, and on whose surface might be placed an array of stacks of paper. One type of stack would employ removable adhesive notes on which information could be recorded, where the notes could be removed and posted to other pages of the leaf or of the host book. Another element which could be mounted on the surface might be an electronic device capable of electronic recording of information, such as a computer device.

Host book spines come in a variety of types for which the invention is intended to be compatible. One type of host book is a multi-ring binder; another type is a finger clasp binder. A third is a spiral binding. A fourth is a glue-bound type. A fifth is a staple-bound variety with a cover mounted over the staple binding forming a cylindrical gap. A sixth is a glue-bound type with a cover mounted over the binding forming a cylindrical gap. A seventh type of book spine would be formed by a post element which would enable the attachment of frames with inner arms that mate to the post.

Other embodiments include various other embedded versions, i.e., versions that fit within a conventional host book of the varieties mentioned. With the appropriate adapters, the embedded versions provide hybrid bindings enabling the combination of the host book spine and its pages in conjunction with a configurable set of hypertext book attachments according to the invention.

One set of embedded embodiments utilizes various forms of the inner arm post as a means for attaching directly to a host book spine. In one variation, the inner arm is a post that fits frictionally into the spine. In another variation, the post is formed with a cap which is used as a retaining means. In a third variation the retaining means is a convex hook attached to the end of the post. A fourth variation would use an ear hook mounted along the post. A fifth variation would have the inner arm formed as a hollow tube offering a female socket for joining to the book spine.

If desired, a retention tube may be fitted and retained within a spiral (or other type) binding of the host book. This tube would have an inner diameter sized to frictionally and pivotably receive the inner arm of the frame. Alternatively, two frames could be used, with shorter inner arms fitting within the retention tube from the top and the bottom. These could be used to hold one frame both from the top and from the bottom or to hold two separate frames.

Another embodiment would include having two frame inner arm members shaped to mate telescopingly, so that one could be inserted from the top of the binding and the other from the bottom. They would telescope together within the binding and so be held in position by friction.

Various means could be employed for retaining the leaf orientation flap on the outer arm of the frame. One variation would provide an adhesive, permanent mount on said free edge of said orientation flap. Another variation would include a set of clamps on the leaf orientation flap which is snapped onto the outer arm post. Yet another variation would provide means for the post to snap into a tube connected to the leaf's orientation flap binding edge. Two frictional variations would include one in which the post fits snugly within a tube attached to the leaf; the other would have the outer arm of the frame kinked slightly such that, upon insertion in a flexible tube attached to the leaf, the friction is increased by direct pressure on the walls of the flexible tube.

There are many variations of adapters. One embodiment would be a simple hollow tube which could be attached to a book spine. A second variation would have spurs on the hollow tube. A third variation would have a slim clip for sliding into a cylindrical gap in the host book spine. Another variation would have a broad clip for attaching to a book cover of a paperback glue-bound book. A fifth variation would include a hollow tube with ear hooks along its edge. Yet another variation would include a hollow tube with rivets. A seventh variation would include a hollow tube mounted on a card wherein the card could be a plain stock, a stock with multiple holes punched or a stock element with a folding crease defining the position for mounting the tube. Any variety of hybrid bindings may also be formed by combining the hollow tube adapter with, for instance, a multi-ring binding. Two variations of this type of hybrid would include a version with the tube mounted on the spine of the multi-ring binder, or a version in which the tube/multi-ring assembly is mounted on a card.

An adapter for a spiral clasp would mold a retaining tube along the length of the spine so as to let the clasps engage freely while allowing the frame to be attached from above or below. The retaining tube could alternatively be positioned within the inner area of the clasps in such a way as to allow the clasps to engage while allowing the pages to turn freely, as in the case of the spiral.

Another adapter would be a card of retangular shape one edge of which houses the retainer for the frame. The retainer might be a tube as in the case above and the card might alternatively have a multi-ring binding on it as well. This hybrid binding would be able to be slipped into the jacket of a host book cover allowing the entire complement of bound leaves and host spine bindings to be moved from cover to cover.

In the case of multi-ring bindings, another embodiment would allow an adapter to be fitted into the rings as a page would be inserted. In this case, the adapter would position the retaining means within the inner area of the ring set allowing the frames to be attached without impacting the mechanism for opening or closing the rings.

A variation that implements frame sets would have the inner arms of two frames joined in a hollow tube adapter which itself was attached to the host book spine. Another frame set variation would have the inner arms of the two frames join as male-female connectors. A third variation would have the inner arms of each frame attach pivotally to the host book through a direct frictional engagement.

Another embodiment would form a new, stand alone type of book with or without conventional pages. In a stand alone embodiment, the frames would be housed in an adapter which became the book spine in and of itself, with the pages of the book including various forms of retained mounting surfaces, each having one or a plurality of folding surfaces mounted thereon.

BRIEF DESCRIPTION OF DRAWINGS

The above and other objects and advantages of the invention will be apparent from consideration of the following detailed description, taken to conjunction with the accompanying drawings, in which like reference characters refer to like parts throughout, and in which:

FIG. 29 shows a perspective view of a book spine with a gap formed by the staple- or glue-bound insert and the cover;

FIG. 30 shows a side view of the book spine of FIG. 29 with the book open;

FIG. 31 shows a side view of the book spine of FIG. 29 with the book closed;

FIG. 32 shows a perspective view of another style of glue-bound book binding with a cover;

FIG. 33 shows a side view of the gap formed when the glue-bound book binding of FIG. 32 is in the open position;

DETAILED DESCRIPTION OF THE INVENTION

Figure 1:
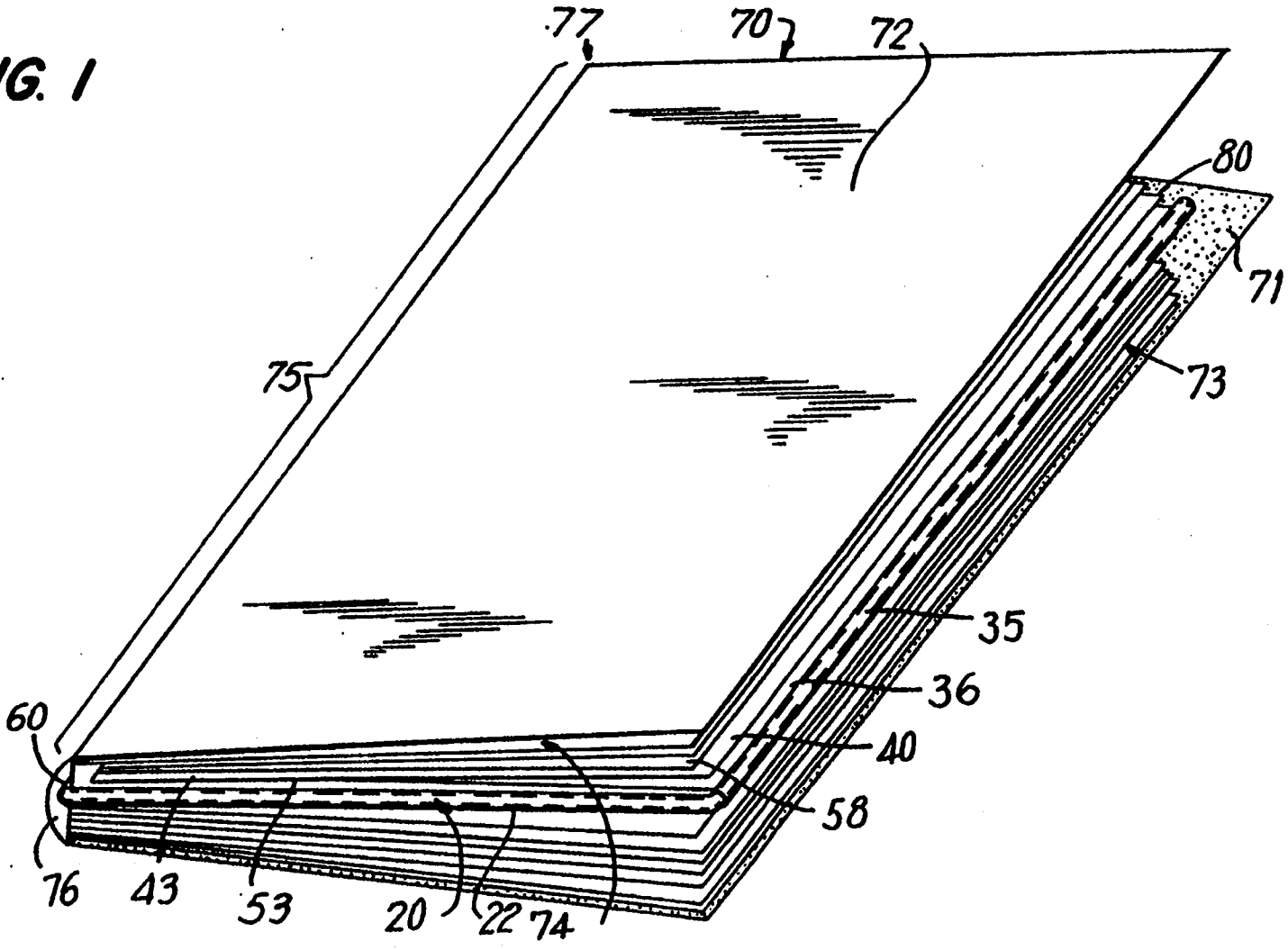
FIG. 1 is a front perspective view of a preferred embodiment of a note book with the attachment binding according to the invention, in the closed position.

A preferred embodiment of the book attachment of the present invention is the leaf and frame shown in FIGS. 1–7. A mechanical (hypertext) attachment 80, for a "blank book" is provided. As seen in FIGS. 1–7, the attachment has a leaf 50 having a plurality of pages 55–58, a mounting surface 40, an orientation flap 30, a frame 20, and a means for attaching the frame to a blank book 70 at the binding point of the book. An edge 32 of the mounting surface orientation flap 30 is attached to frame 20 via a retaining tube 35, and the frame 20 is attached to the book by means of an inner arm 23 and an adapter 60, where the inner arm 23 fits into the bottom of the adapter 60 through opening 61, with the adapter inserted into the book spine 75 through gap 76.

The mounting surface 40, has an orientation flap 30 having a width substantially half the width of mounting surface 40. Orientation flap 30 is attached to mounting surface 40 laterally along the back of mounting surface 40 on a line defined by the points midway in from the parallel edges of mounting surface 40, with its outer edge 32 free to be bound to the outer arm 21 (connected by connector arm 22 to inner arm 23) of frame 20 by a suitable hinge to enable it to rotate about the outer arm 21.

Figure 2:
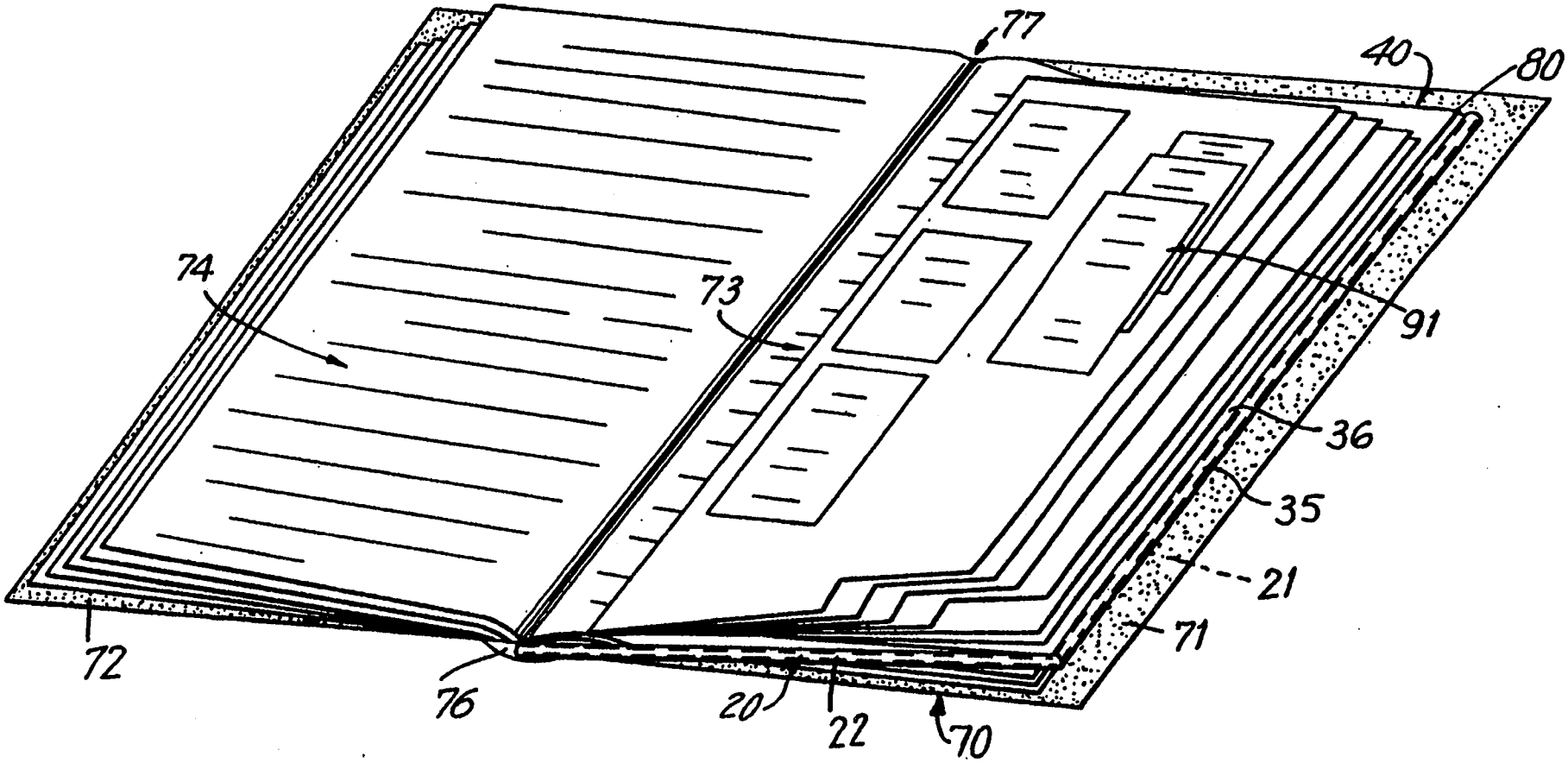
FIG. 2 is a front perspective view of the book attachment of FIG. 1 in the open position with the attachment positioned within the book.
Figure 3:
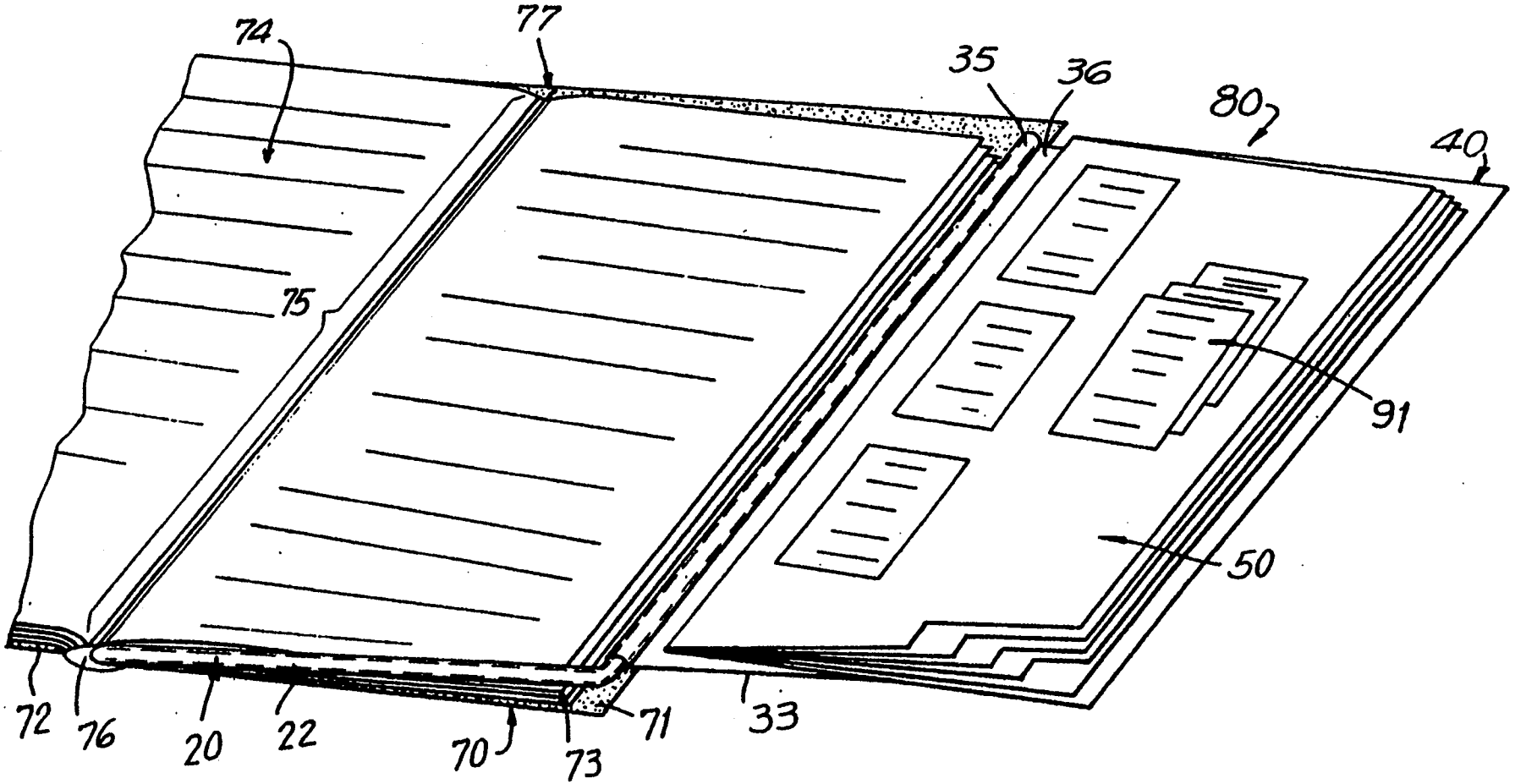
FIG. 3 is a front perspective view of the book attachment of FIG. 1 in the open position, with the attachment extended to the right along side the book.
Figure 5:
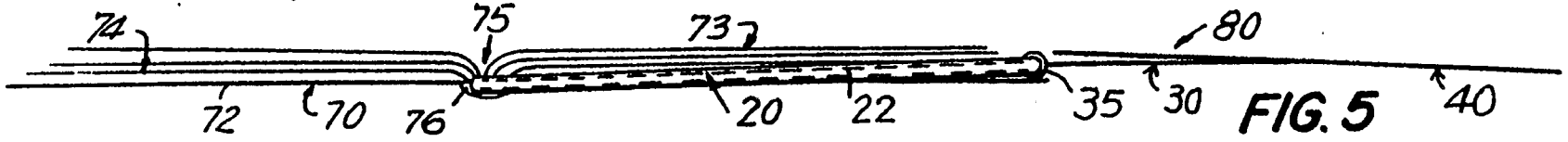
FIG. 5 is a cross-sectional view of the attachment of FIGS. 1–4, taken on line 5—5 of FIG. 4.

Mounting surface 40 hinges on the orientation flap 30 which rotates about outer arm 21 so as to position the flap surface out of the way of the pages of host book 70 allowing for the pages of host book 70 to be turned freely and enabling mounting surface 40 to be reinserted arbitrarily at any point in host book 70 like a book mark, and allowing book 70 to close flatly with the connector arm of frame 20 seated within the perimeter of the covers of host book 70 and not interfering with any of the pages of the host book. The plurality of pages 55–57, attached to mounting surface 40, thus become an add-on to the host blank book 70, and include one or more folded surfaces, envelopes, pouches, or the like capable of holding or storing information, notes, lists, removable adhesive notes, or loose pages of any type, each plane offering a plain view of its contents when opened to. And as shown in FIGS. 2 and 3, with inner arm 23 of frame 20 attached to the host blank book 70 by means of a suitable adapter 60 that allows the combination of frame 20, orientation flap 30, and mounting surface 40 to rotate about the binding point of host book 70 to which it is attached. The element 80 shows a leaf embodiment as a hinged structure having a mounting surface with opposing lateral edges, and an orientation flap pivotally attached at a first end thereof to the mounting surface between the opposing lateral edges of the mounting surface, and said orientation flap having a pivotal coupling structure at an opposing end thereof. The leaf can be rotated about outer arm 21 of the frame 20, and the entire frame and leaf can be rotated about spine 75. The leaf mounting surface 40 is so attached to frame 20, and the frame 20 so attached to book 70, that mounting surface 40 and its plurality of surfaces 50, may be positioned on either side of blank book 70, to be extended to either side of book 70 or, as shown in FIG. 1, to be folded into the book on either side while retaining the same orientation of the mounting surface 40. This property, enabled by the orientation flap, permits retention of the orientation of the mounting surface in a plurality of positions, not only with respect to a host book but with respect to the different positions of the mounting surface itself, and enables the property referred to earlier as windowing. In this way the plurality of pages 55–57 may be placed in a position allowing their outer edges 59 to be accesible in the same fashion of the pages 73 of book 70. If mounting surface 40 is flipped on orientation flap 30 so that the edges 59 of the floating pages 55–57 are adjoining book spine 75, the retaining edge 35 of orientation flap 30, the edge 44 of the mounting surface 40 and the flat binding edge 54 of the plurality of pages form a single edge. The single edge formed by these surfaces is accessible as a single page operating as a marker. Orientation flap 30 and mounting surface 40 may be semipermanently joined at that single edge using hook-and-loop-type fasteners, magnets, tape and the like, or by a spring or clip mechanism. The purpose of providing a joining means is to allow mounting surface 40 and orientation flap 30 to join and operate cohesively as a single surface when desired, while not restraining their separation and free motion, and allowing for the reconfiguration of the mounting surface to a position on either side of the book, either within or along side the host book.

Figure 4:
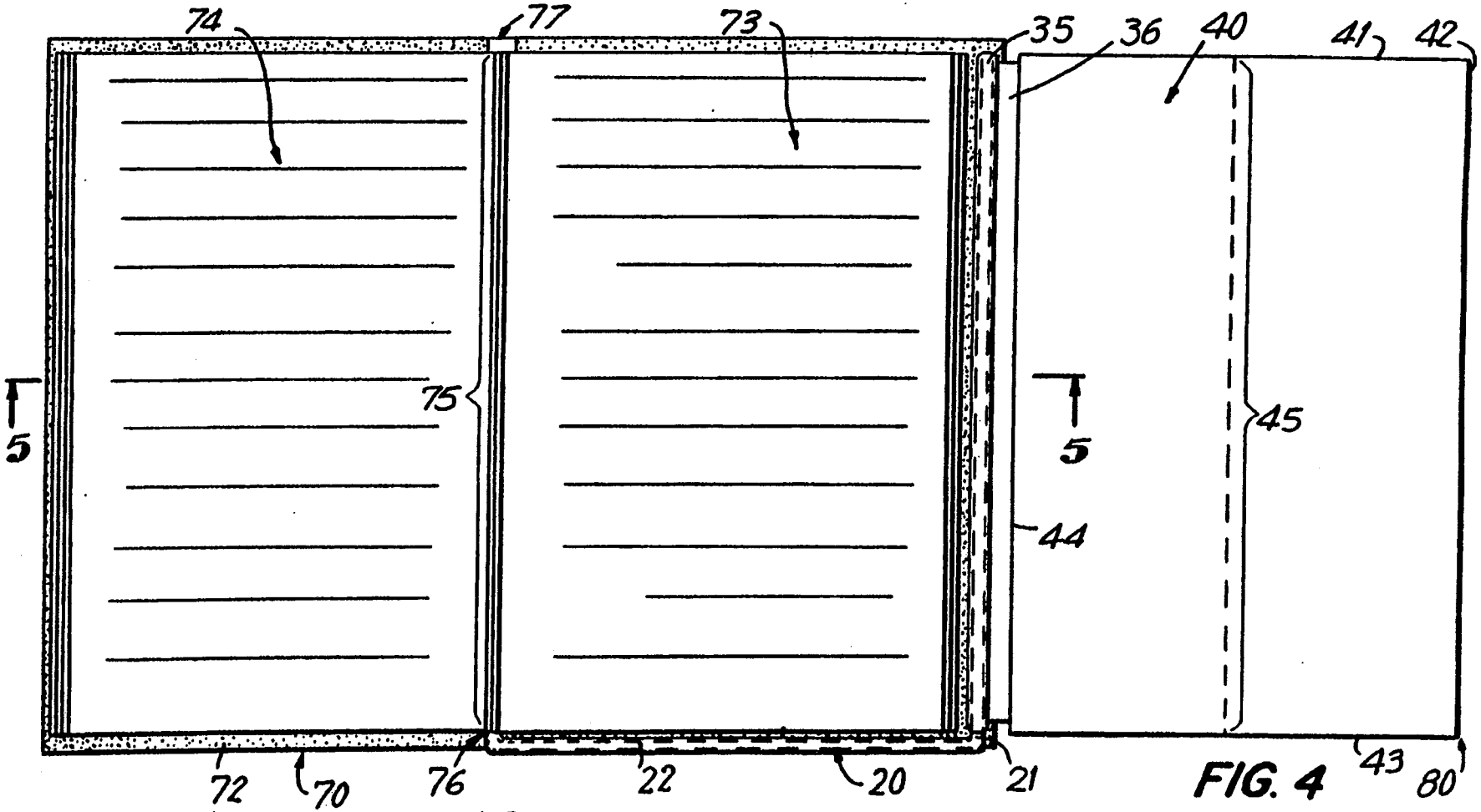
FIG. 4 is a front elevational view of FIG. 3.
Figures 4A, 5A:
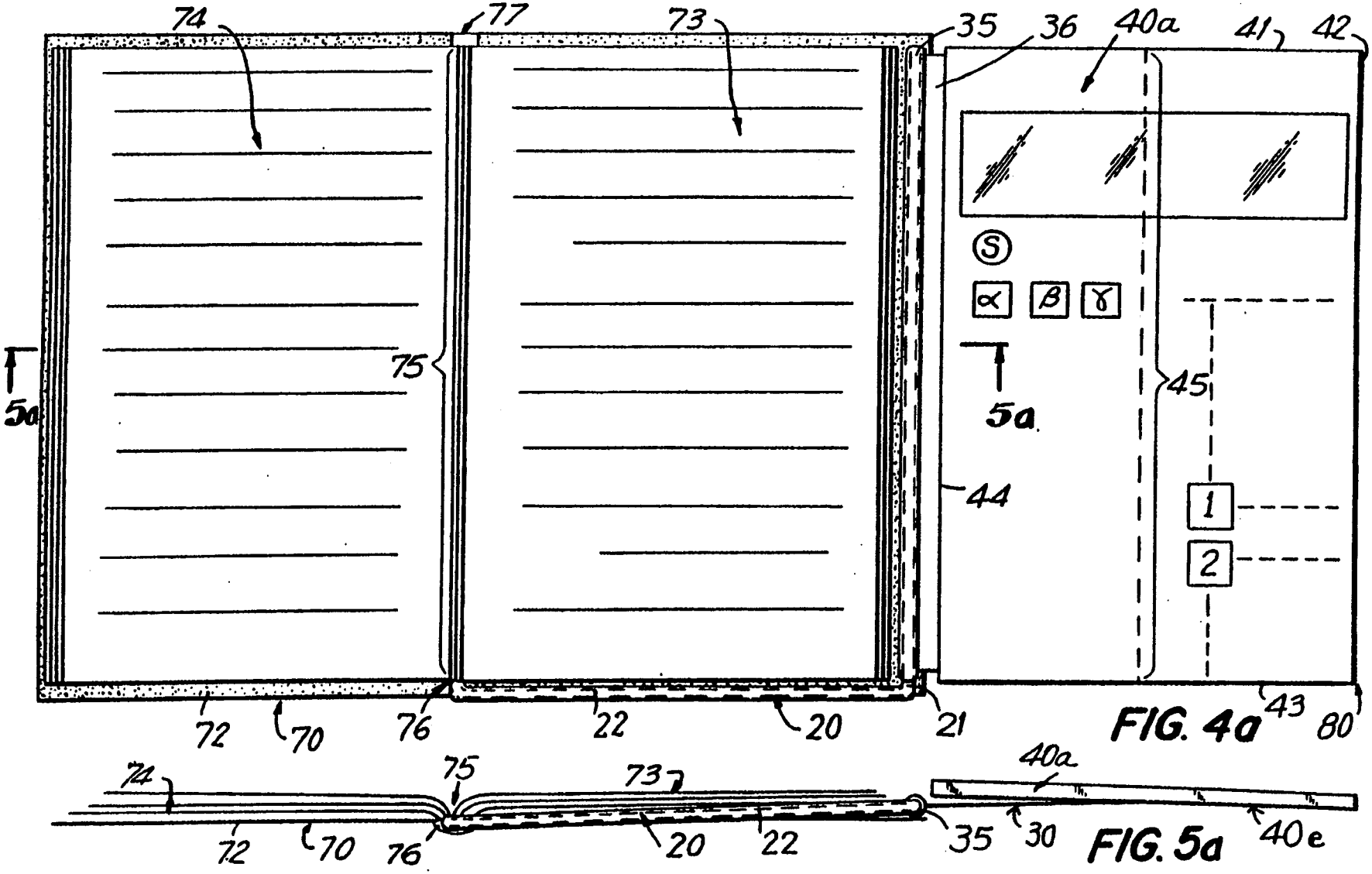
FIG. 4*a* is a front elevational view of a leaf mounting surface with an electronic device mounted thereon.
FIG. 5*a* is a cross-sectional view of the leaf mounting surface of FIG. 4*a*, taken on line 5*a*—5*a* of FIG. 4*a;*
Figure 6:
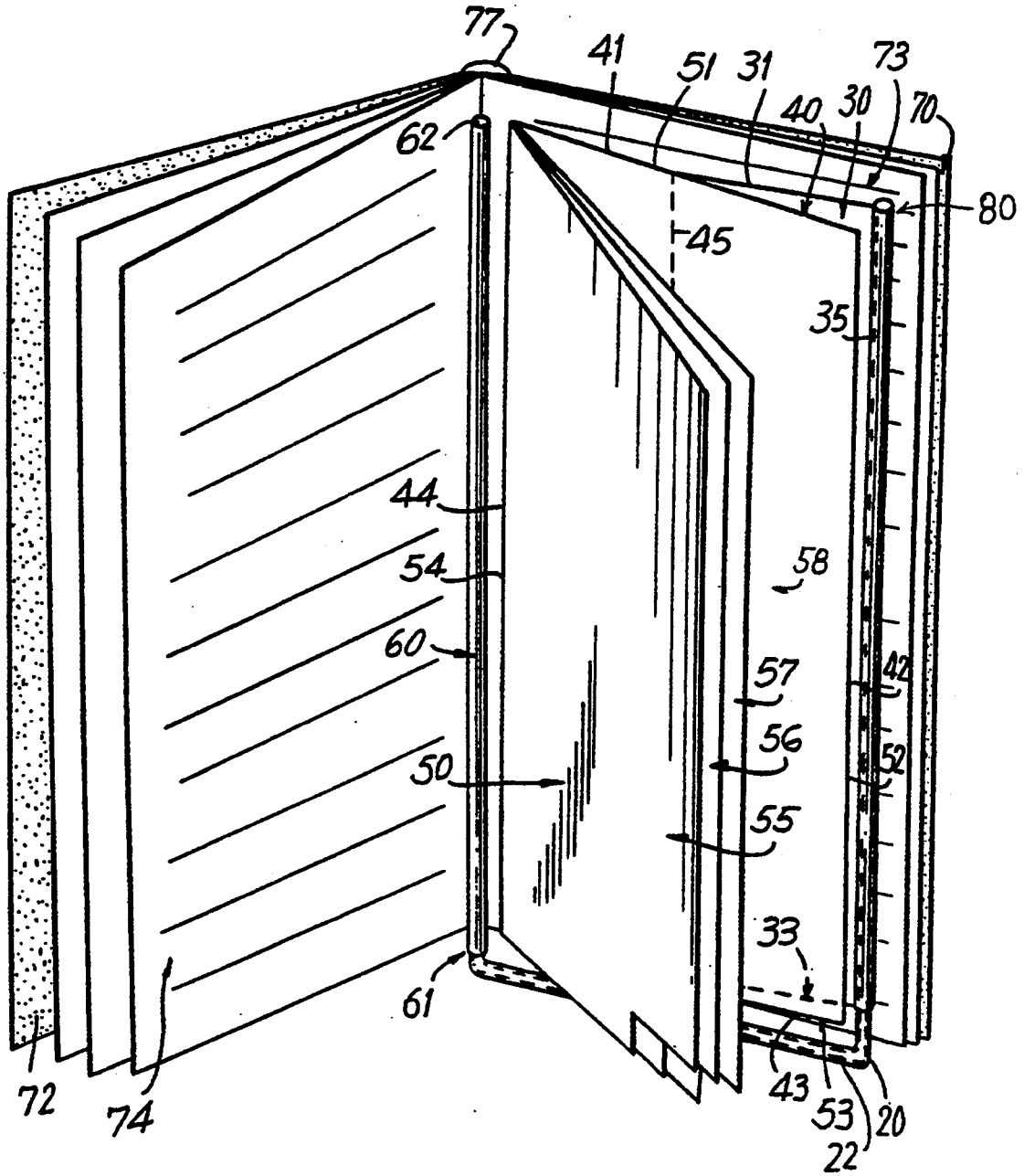
FIG. 6 is a front perspective view of the book and book attachment of FIG. 1 with the book open and the adapter mechanism exposed along with its frame and leaf attachment.
Figure 7:
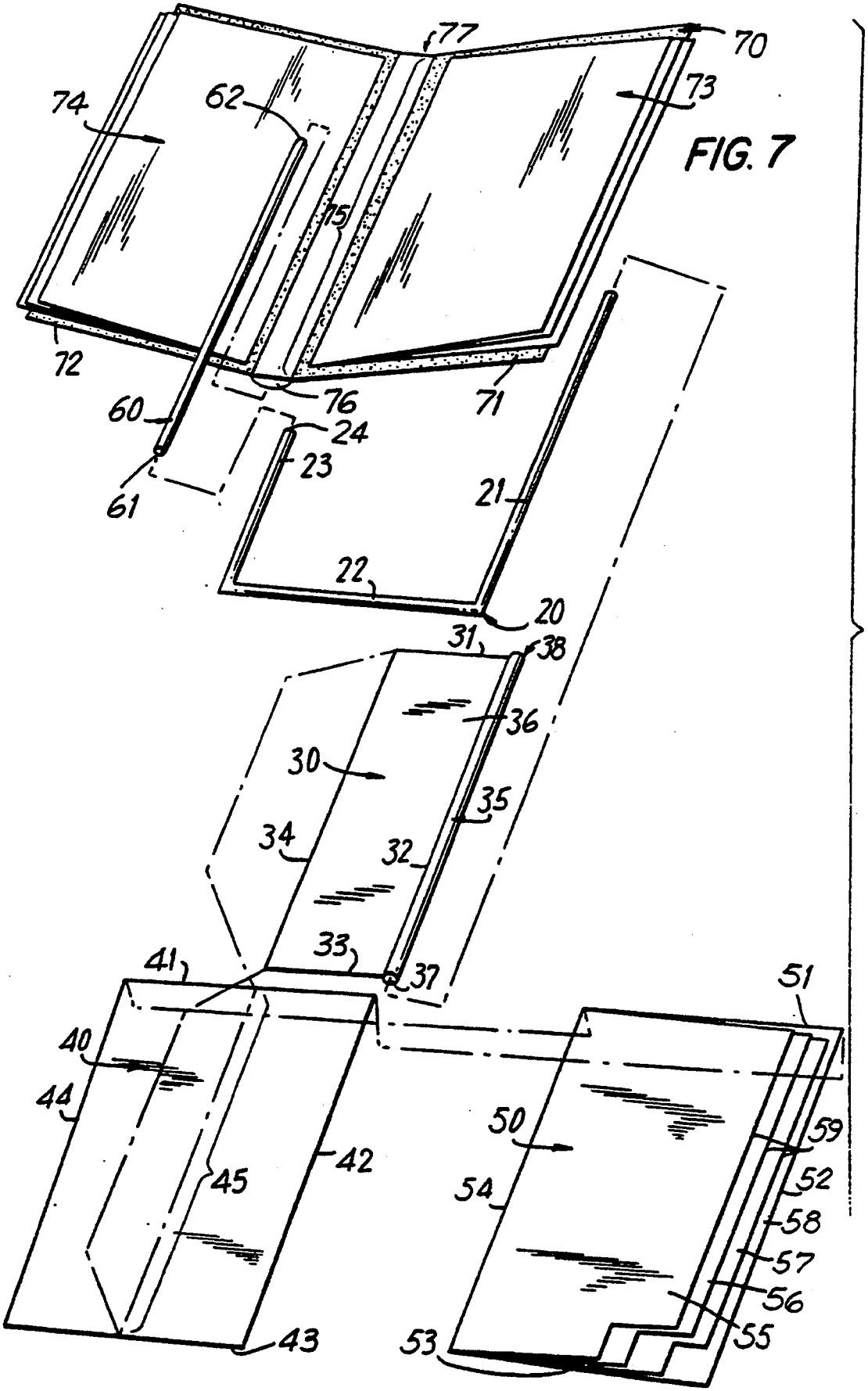
FIG. 7 is an exploded perspective view of the book and book attachment of FIGS. 1–6 showing a frame, an orientation flap, a mounting surface, a plurality of folding surfaces, an adapter fitting, and a host book.

FIG. 4*a* shows an electronic module, 40*a*, herein shown as a calculator mounted on surface 40. FIG. 5*a* shows the cross section view of the electronic module. It is possible to construct such an assembly by attaching the orientation flap directly to the electronic module. Alternatively, the orientation flap may be constructed in a variety of ways, not limited to a flap, a wire frame, or the like structure. The electronic module may be mounted in a pocket or otherwise affixed to the orientation flap. The electronic device may be any device not limited to a calculator, application specific microprocessor, and the like.

Figures 50, 51, 52, 53, 54:
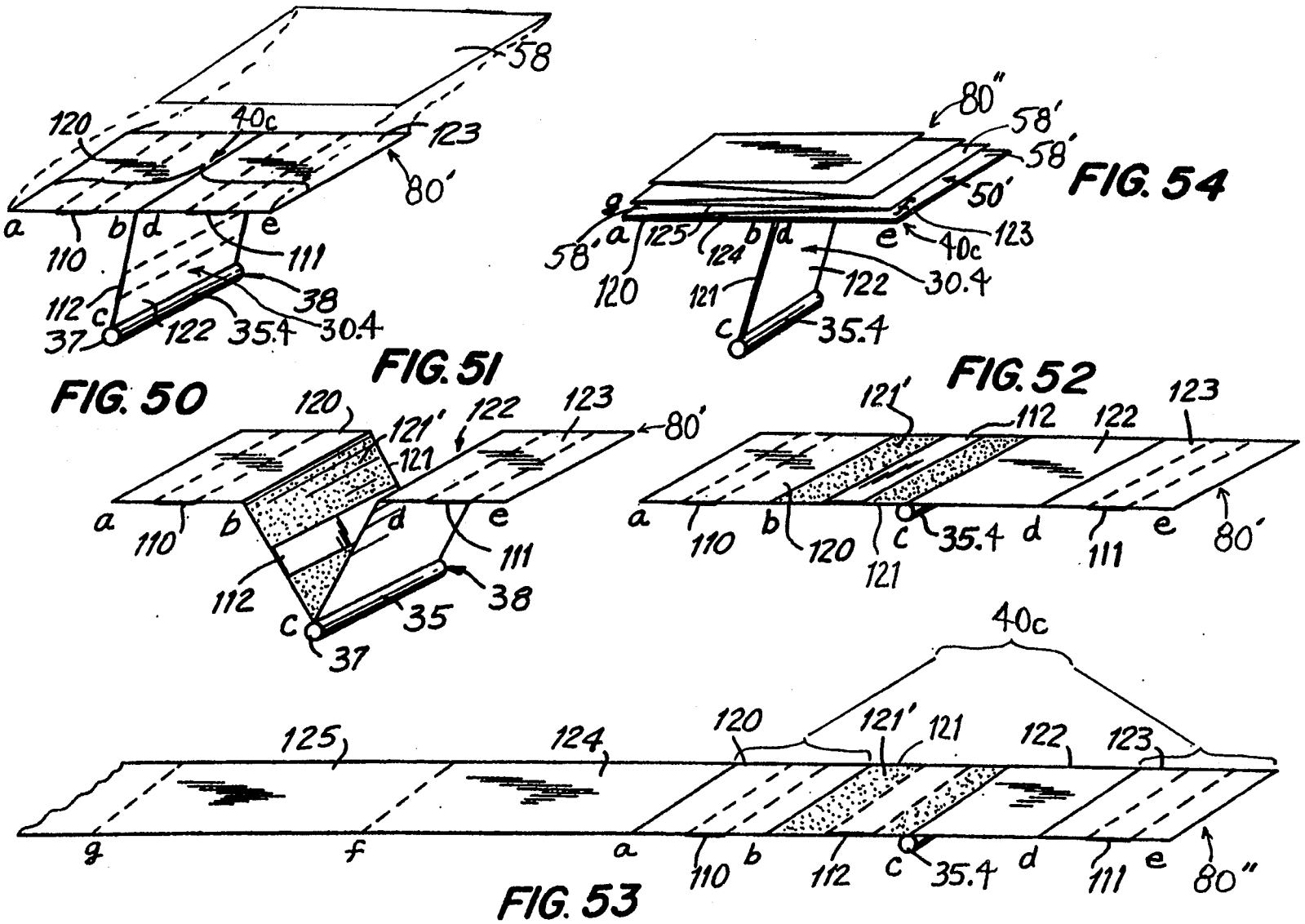
FIG. 50 shows a perspective view of a mounting surface, having sections 120 and 123, and orientation flap with a tube adapter and a retentive mechanism as cut from one piece of material showing corners a, b, c, d and e.
FIG. 51 shows corners a, b, c, d and e of FIG. 50 partially separated in perspectve.
FIG. 52 shows a perspective view of FIG. 50 where the leaf comprising 2 surface sections and 2 orientation flap sections is extended and laid in a single plane, with the pivotal adapter shown in the middle.
FIG. 53 shows the leaf of FIG. 50 with surface extensions f–g laid in a single plane.
FIG. 54 shows the leaf of FIG. 53, with the additional surface folded into a set of pages, all formed from the single piece of material.

FIG. 7*a* shows a construction using the embodiment of FIG. 50 to form a hinged window construction. The stiffened leaf bottom 58 is attached to the mounting surface formed from wings 120 and 123 to enable a rigid planar rectangular structure. Although the magentic strips are not shown here, but one can easily see that the formation 50 when used as the proposed building block and having the magnetic strips, in combination with(attached to the top by standard attachment means such as by adhesive attachment-note laminating by adhesively attaching a plastic stiffener has been suggested as well) an accessory such as the plastic sheet, or stiffened pad pad bottom(alternatively, an electronic device or other stiff element could be used as described herein), would then semi-permanently lock when placed lying flat in either position.

FIG. 7*b* shows the side view of FIG. 7*a* highlighting the combination of layers which allow for an operating windowing construction.

The sizes of the respective surfaces have been described for a preferred use within a host book. However, the above described mechanism would work well with surfaces having lengths of varying proportion, while still being within the scope of the invention. The book attachment shown herein provides a repositionable surface which allows for a surface intensive blackboard with optional surfaces which can be labelled, typed, categorized and retyped as suits the application, as well as to be placed as a mark in any page of a book.

Alternate embodiments employ variations on the frame, types of leaf, means for binding the leaf to the frame, and means for binding the frame to the host book, each variety of host book binding style requiring a different preferred mechanism of attachment.

Figure 34A:
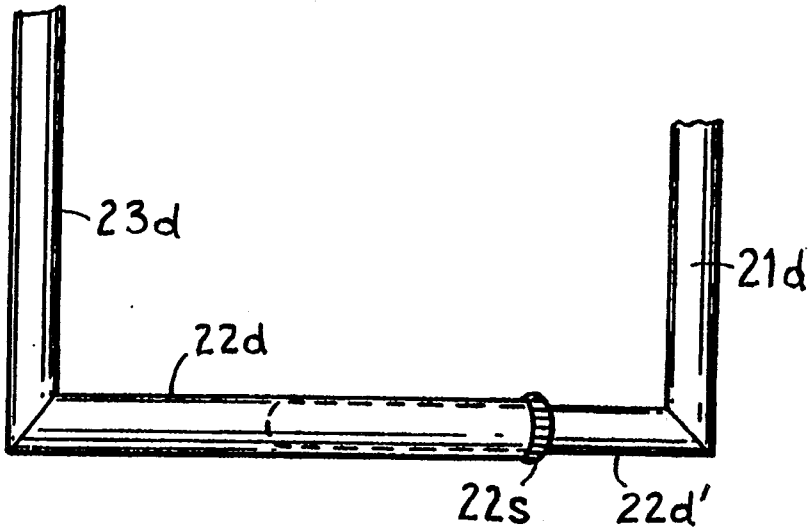
FIG. 34*a* shows means for adjusting a connector arm of a frame.
Figure 34:
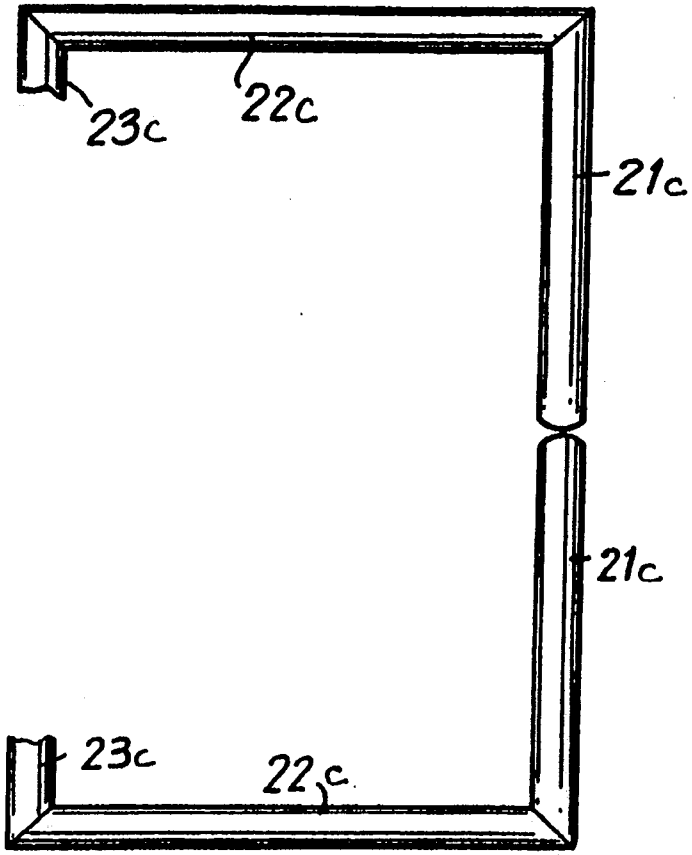
FIG. 34 shows a front elevational view of a frame set where the frame pair is used to retain a single leaf.

As shown in FIG. 34, a frame may utilize two members where the connector arms 22 are identical in length, and outer arms 21 join in supporting a leaf member. This configuration would be employed for increased stability of the assembly. FIG. 34*a* shows a means for adjusting connector arm 22 by means of a slide adjustment 24.

Figure 8:
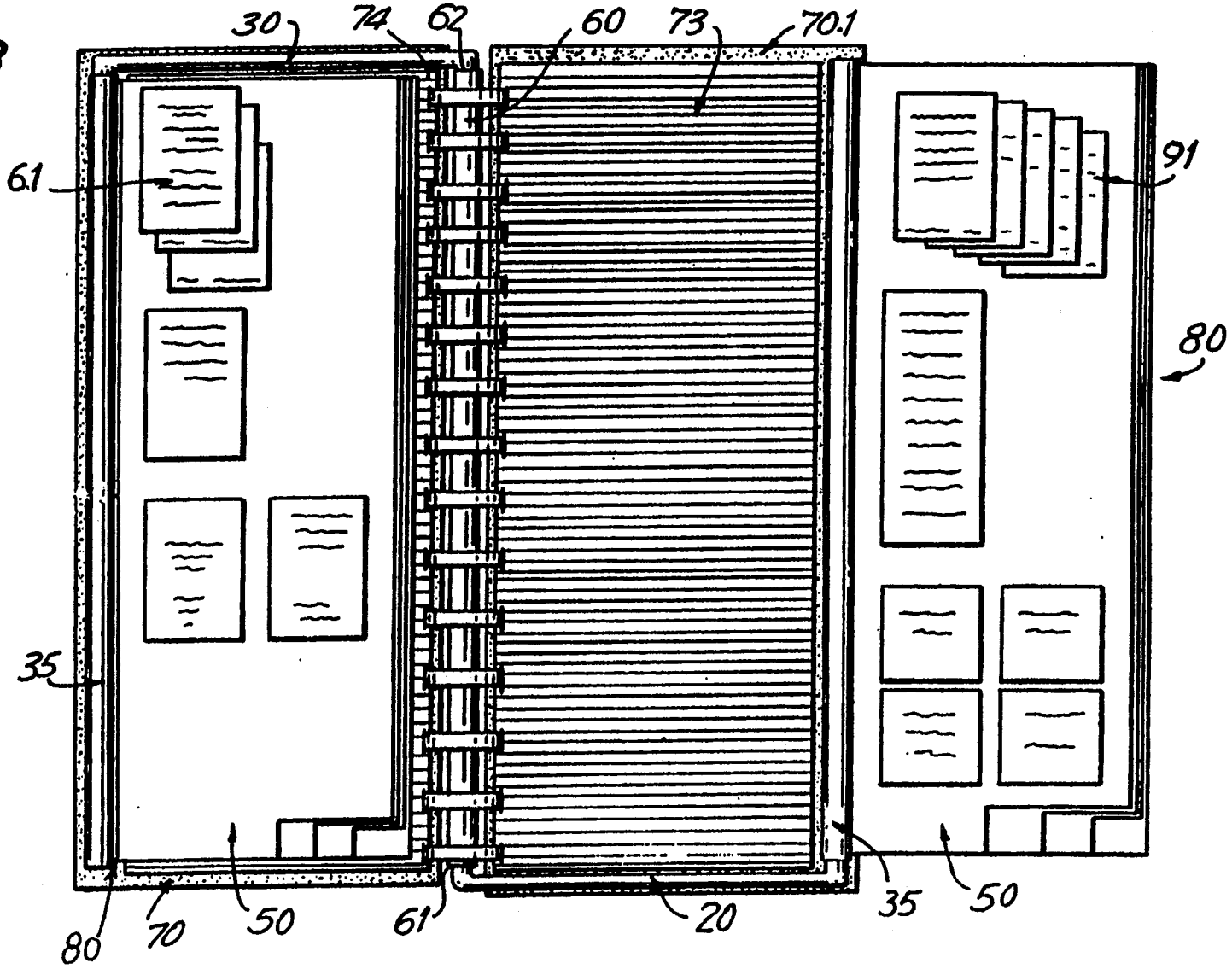
FIG. 8 is a front elevational view of a spiral-bound book fitted with a retention tube and two frame members, each with a plurality of surfaces, with member folded to rest within the book, and the other extended to the side showing a page of the host book in plain view.
Figure 13:
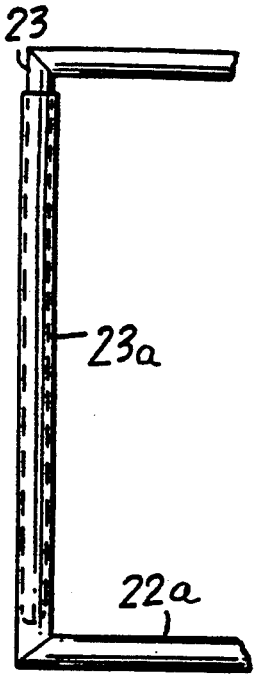
FIG. 13 shows a frame set in which a pair of frames are combined by means of a joinder sleeve.
Figure 41:
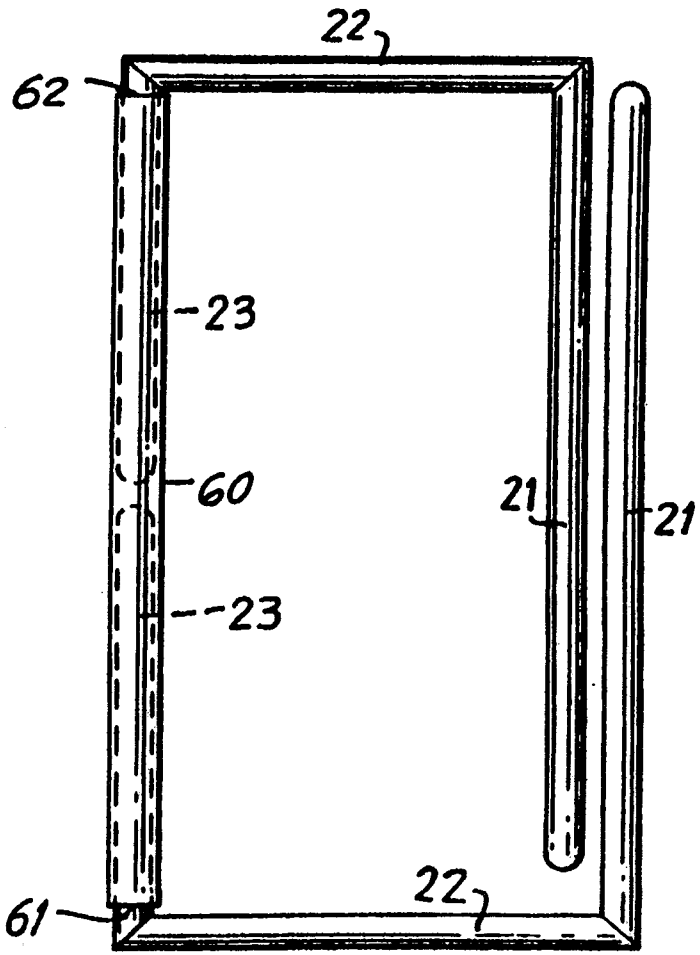
FIG. 41 shows a frame set showing the interleaving arrangement of each frame outer arm where the inner arms are connected by a hollow tube adapter.
Figure 40:
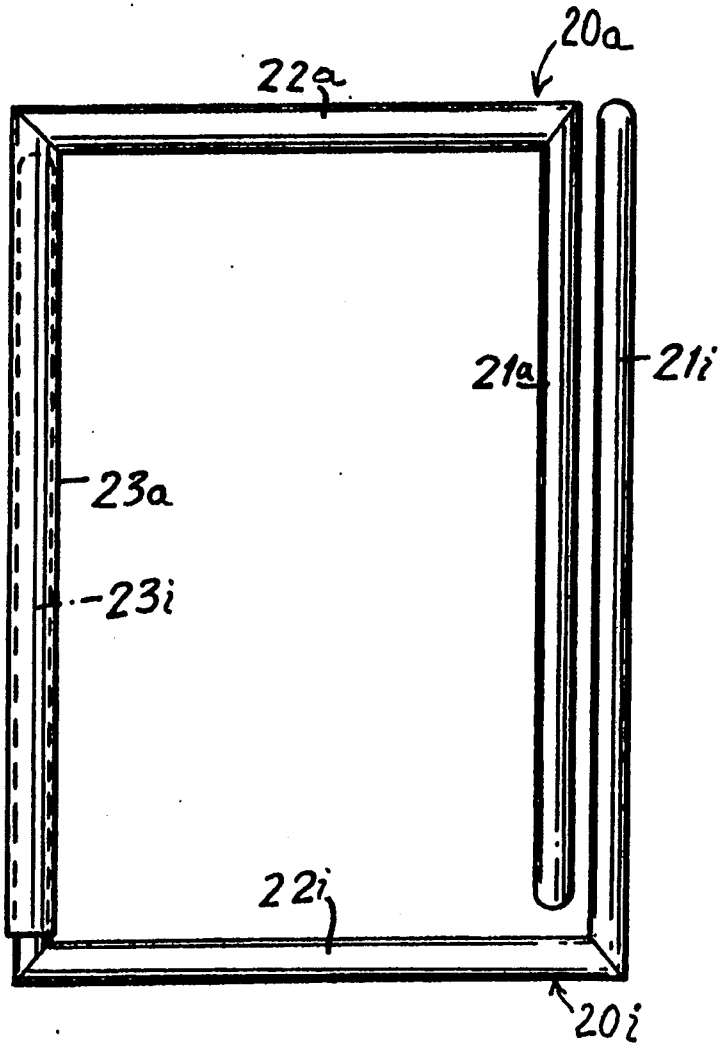
FIG. 40 shows a frame set showing the interleaving arrangement of each frame outer arm where the inner arms are connected by a joinder sleeve.

FIG. 40 shows a frame set which would be employed for supporting two leaves. In this case the connector arms 22 are sized to allow the frame outer arms 21 to pass one another without interference. In FIGS. 13 and 40, the frame inner arms mate male-to-female, while in FIG. 41 they are joined by a hollow tube adapter 60. Another variation of this would have the inner arms 23 of FIG. 41 join directly to the host book spine without the aid of adapter tube 60. FIG. 8 shows how the frame set of FIG. 41 would be utilized in a spiral binding.

Figure 44:
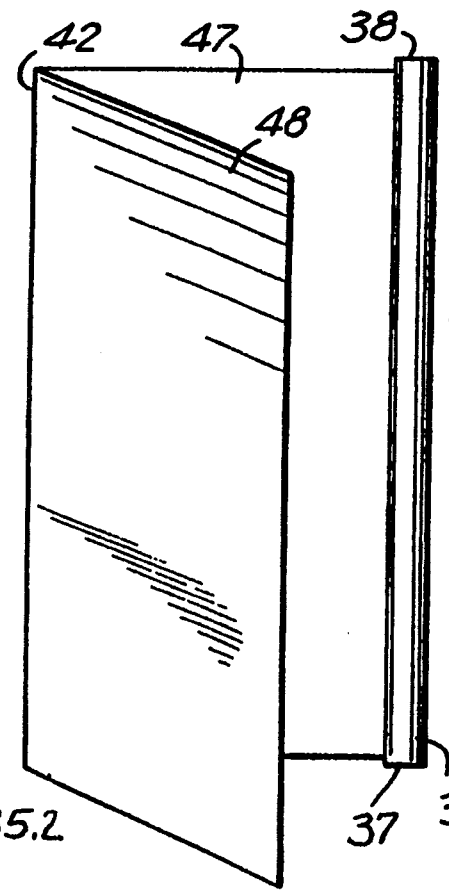
FIG. 44 shows a set of mounting surfaces in an "L" configuration with the hollow tube adapter attached at the mounting edge.
Figure 43:
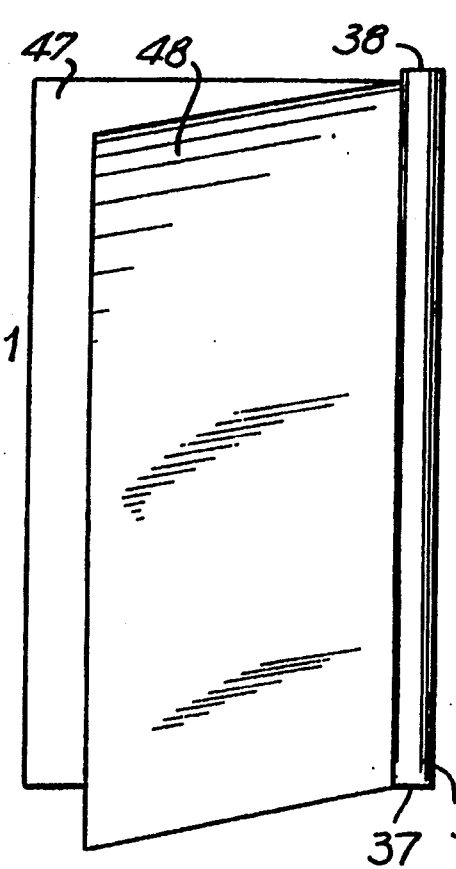
FIG. 43 shows a set of mounting surfaces in a "V" configuration with a hollow tube adapter attached at the mounting edge.
Figure 42:
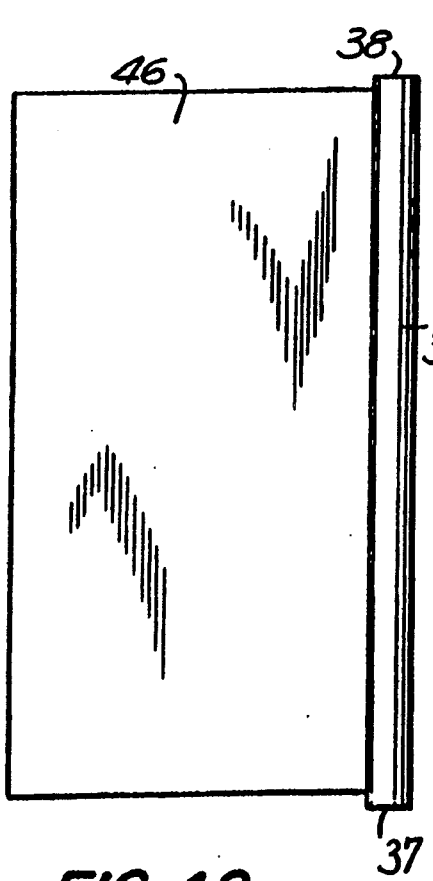
FIG. 42 shows a leaf with a rectangular mounting surface and mounting edge with a hollow tube adapter.
Figure 48:
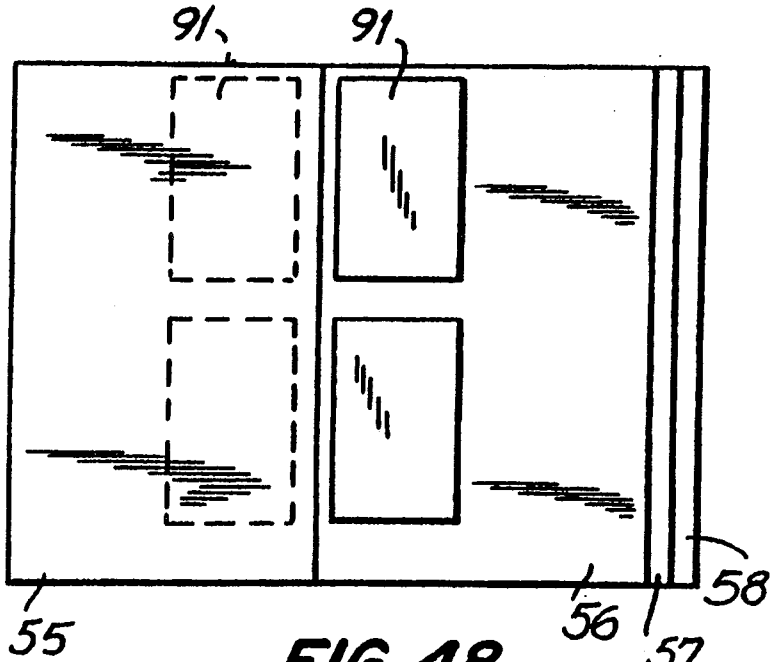
FIG. 48 shows the plurality of folding surfaces of FIG. 46 with the top cover opened showing the inner set of adhesive note stacks.
Figure 49:
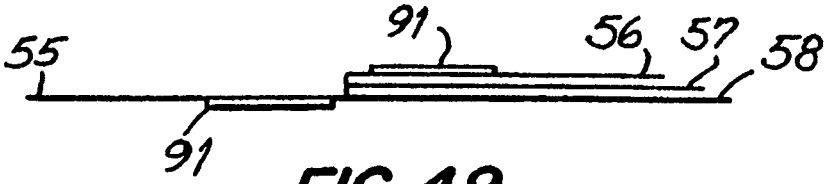
FIG. 49 shows a side view of the folding surfaces of FIG. 48.
Figure 46:
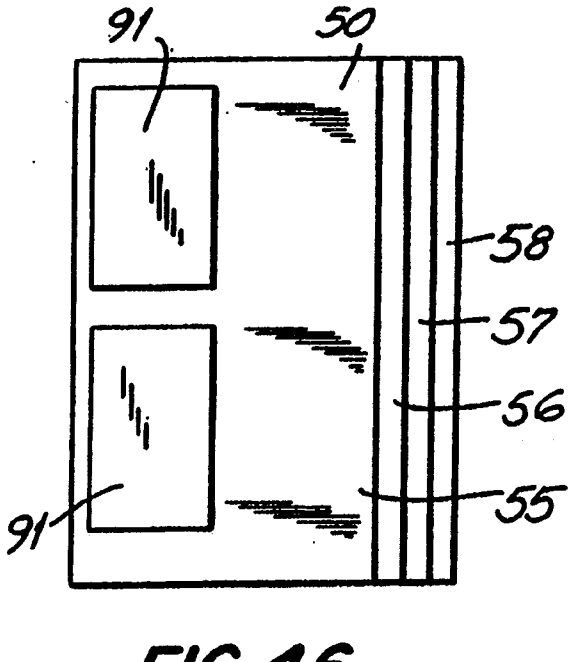
FIG. 46 shows a plurality of folding surfaces with a set of adhesive note stacks on the top and inner covers.
Figure 47:
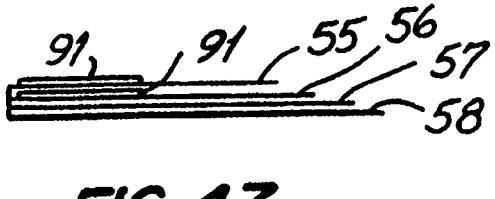
FIG. 47 shows a side view of the folding surfaces of FIG. 46.

Various leaf types would offer different options in the use of a deployed hypermedia system. FIG. 42 shows a basic configuration where the leaf 46 is a simple rectangle which could be deployed as a mounting surface. FIG. 43 shows a dual leaf configuration with leaf members 47, 48 joined at their binding edge. FIG. 44 shows the leaves 48, 49 joined to form a folding rectangular shape with one binding edge 42.

Figure 45:
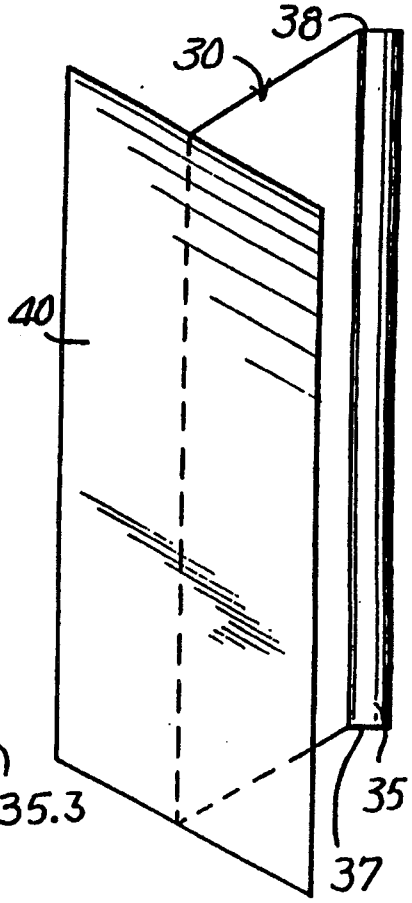
FIG. 45 shows a mounting surface orientation flap leaf configuration with a hollow tube adapter attached at the mounting edge of the orientation flap.

FIG. 45 shows the preferred embodiment of the mounting surface 40 with orientation flap 30 which operates as an orientation enabler that preserves the orientation of surface 40 in each configuration about the frame. Here, the configuration of FIG. 45 is shown constructed with a wing section mounting surface portion 120 an orientation flap 121 and a mounting plate formed with the stiff section 58.

Various surfaces as hypermedia structures could be attached to mounting surface 40. FIGS. 46–49 show a different configuration of a plurality of surfaces used to support arrays of note stacks 91. As shown here, note stacks 91 themselves are sets of removable adhesive notes which provide a means for collecting information and can be written on incrementally and pasted many times among the pages of the attachment as well as among the pages of the host book. The plurality of folds could also be labeled for various purposes. The folds could host pre-printed forms, envelopes, pouches, or electronic devices such as calculators and other application-specific microcomputers. For example, FIGS. 4*a* and 5*a* show a calculator module 40*a* mounted on mounting surface 40.

Figure 39:
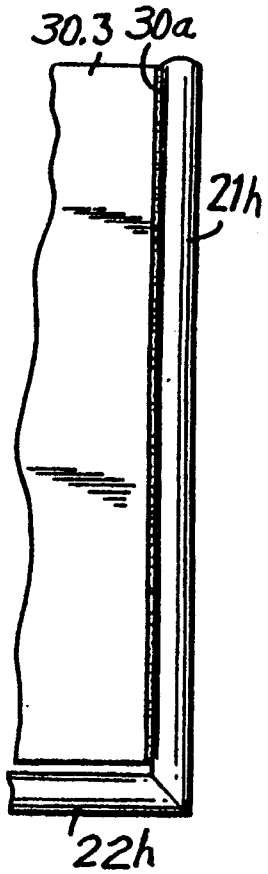
FIG. 39 shows a frame outer arm and leaf where the leaf is adhesively attached to the frame outer arm.
Figure 38:
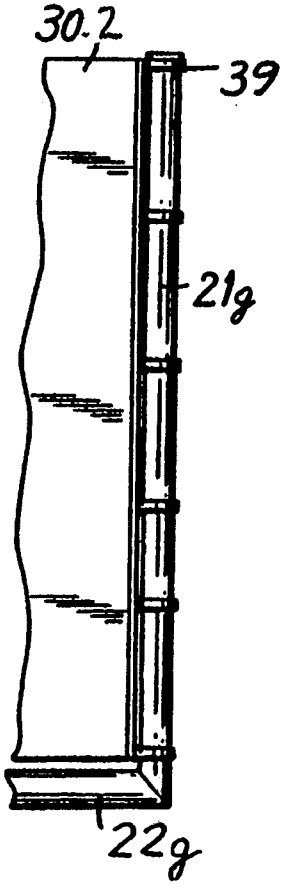
FIG. 38 shows a frame outer arm and leaf where the leaf has a set of fingers that snap onto the frame outer arm.
Figure 37:
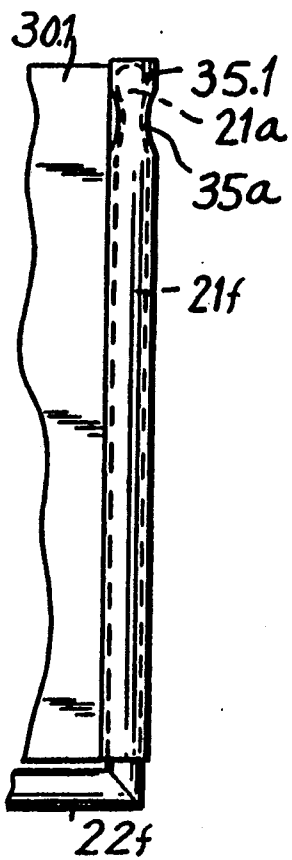
FIG. 37 shows a frame outer arm and leaf where the leaf binding edge has a hollow tube with a retainer and the post has a bulbous shape suitable to snap within the tube.
Figure 36:
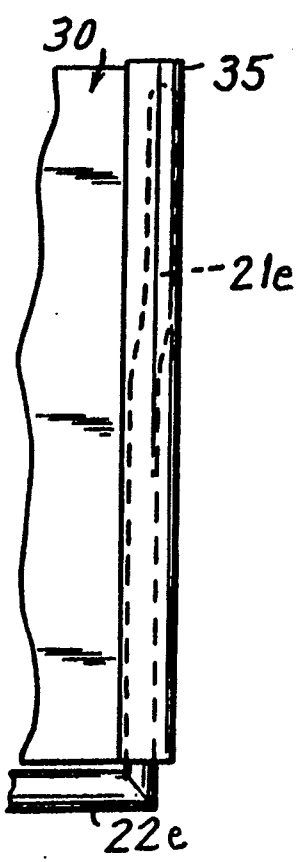
FIG. 36 shows another means of frictional joining with a frame leaf configuration.
Figure 35:
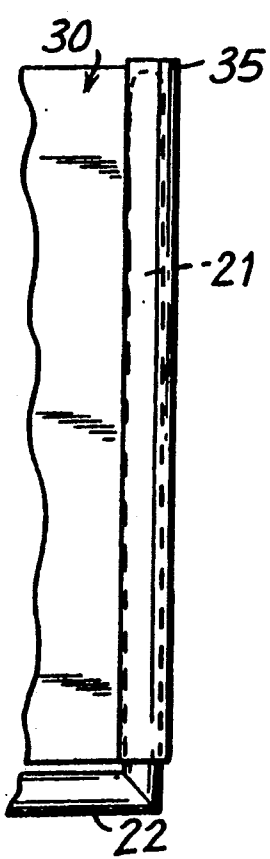
FIG. 35 shows a binding of a frame outer arm to a leaf where the frame is a post, the leaf has a hollow tube receptor, and the means of joining is frictional.

Various means can be employed for retaining the leaf orientation flap on the outer arm of the frame. In FIG. 39, the leaf 30 is attached to the outer arm 21 with a permanent, flexible, adhesive mount 30*a*. Another variation shown in FIG. 38 would employ a set of clamps 39 on the leaf orientation flap 30, which snap onto the outer arm 21. Yet another variation, FIG. 37, shows a means for the posts 21 to snap into a tube 35 to the leaf's orientation flap binding edge. The means for snapping could vary. One type includes the use of a post 21 with a bulbous end 21*a* that slides past a flexible construction 35*a*. Two frictional variations are shown in FIGS. 35 and 36. In FIG. 35, post 21 is a straight member that fits frictionally into tube 35. In FIG. 36, the post is kinked slightly to place varying pressure on tube 35 ensuring a frictional fit.

Figure 55:
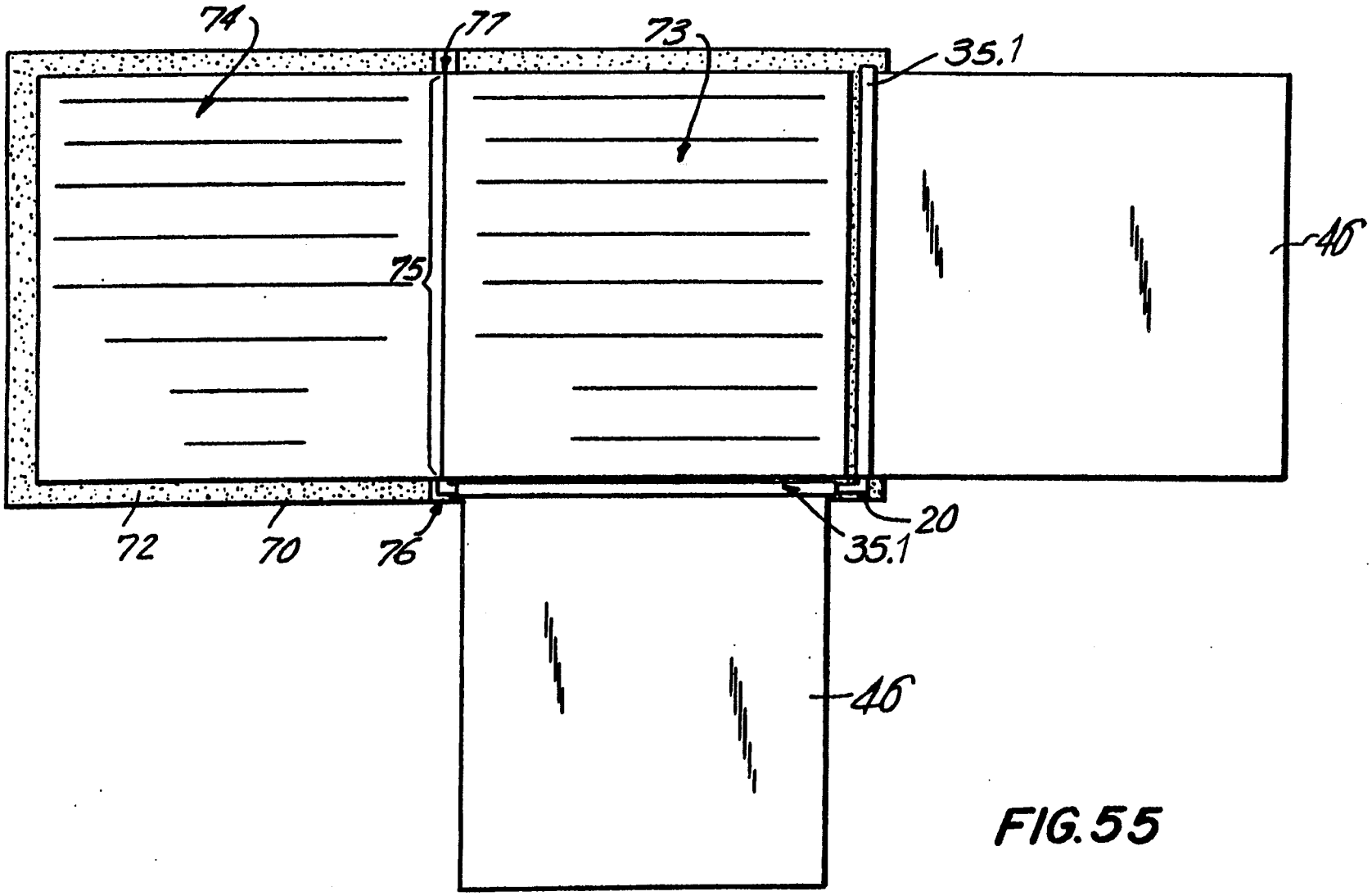
FIG. 55 shows a host book with a leaf member attached to both the connector arm and the outer arm of the frame member.

Leaf members may be attached to either outer arm 21 or connector arm 22. FIG. 55 shows a host book with a frame supporting two leaf members 40.

Figure 14:
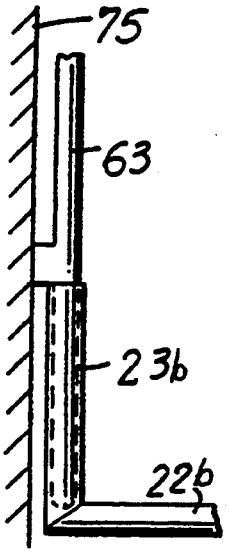
FIG. 14 shows a frame set male host with inner arm of frame member of female construction.
Figure 25:
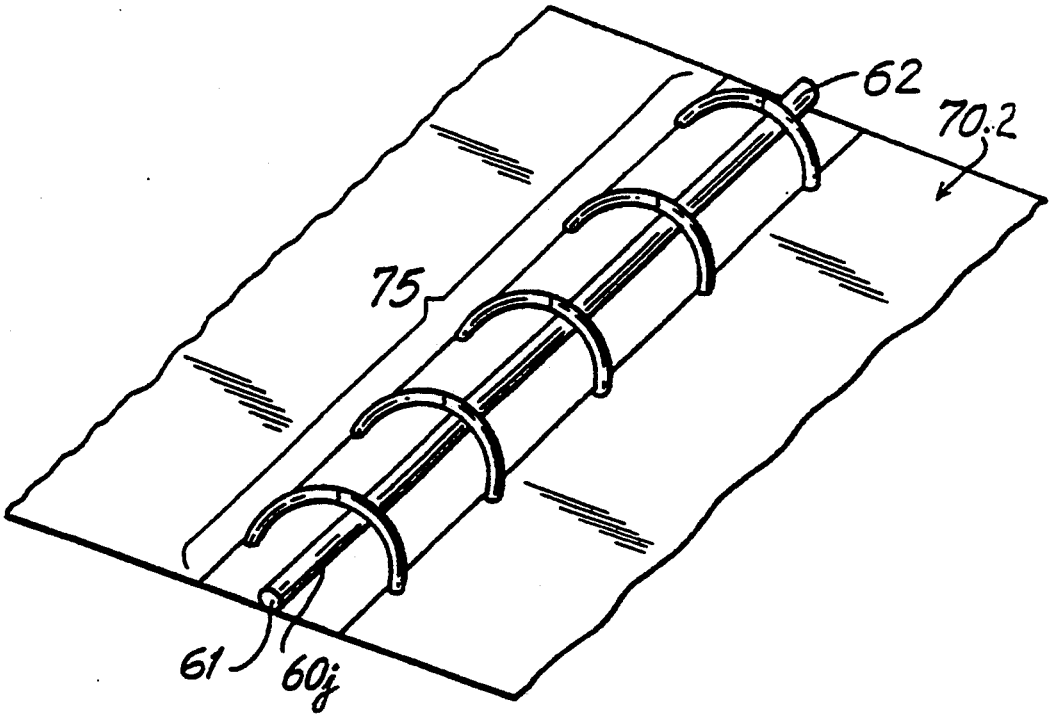
FIG. 25 shows a hollow tube adapter in a hybrid binding configuration mounted within a multi-ring binder.
Figure 26:
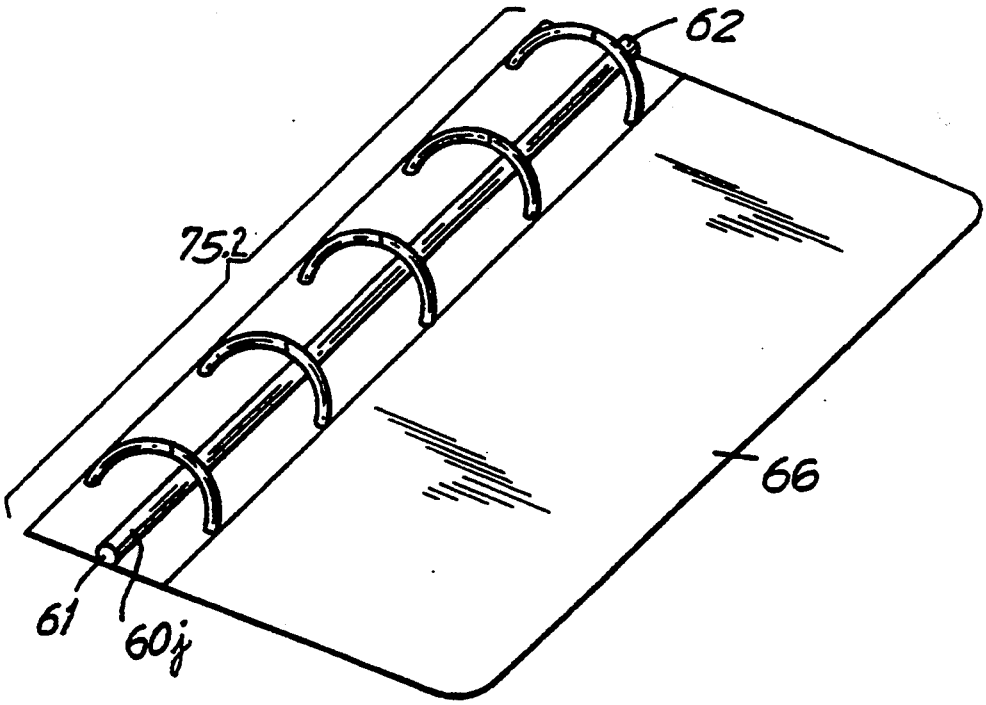
FIG. 26 shows a hollow tube adapter on a card with a multi-ring adapter.
Figure 27:
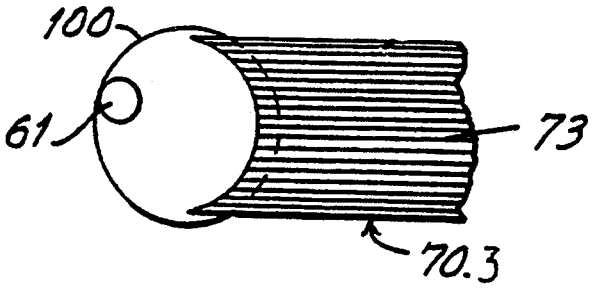
FIG. 27 shows a side view of a finger clasp spiral-style binding with tube adapter.
Figure 28:
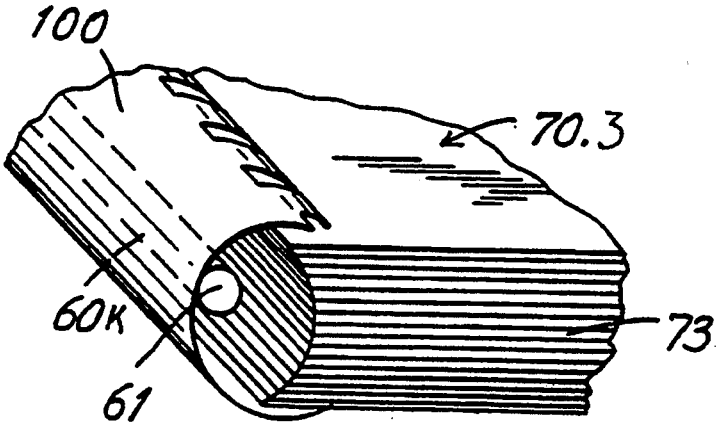
FIG. 28 shows a perspective view of the binding of FIG. 27.

Host book spines come in various types. FIG. 14 shows a spine formed by a post 63 capable of supporting two female inner arms, one of which is shown at 23. FIG. 29 shows the gap 76 formed along spline 75 when a cover is adhered to a set of either glue- or staple-bound pages. FIG. 30 shows a side view of the gap when the book is open and FIG. 31 shows a side view of the gap when the book is closed. FIG. 32 shows a similar gap formed by a different variation of glue-bound binding. FIG. 33 shows a side view. FIG. 27 is a side view of finger clasp binding shown in FIG. 28. A hollow tube adapter 60 is shown as part of the binding as a means for hosting frame inner arms. The adapter tube is sized to allow the pages to turn freely. The spiral binding gap of FIG. 8 is another type of host spine for which the present invention is compatible. Additionally, a variety of hybrid bindings formed by an adapter and a standard multi-ring binding are shown in FIGS. 25, 26. In FIG. 25, a hollow tube adapter 60 is fitted directly to spine 75 of the multi-ring binding. In FIG. 26, the multi-ring binding 75 and the adapter tube 60 are mounted on a card 66. The card may be deployed in the jacket of a host book cover.

Figure 9A:
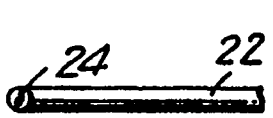
FIGS. 9 and 9*a* show elevational and top views, respectively, of a frame member inner arm post construction.
Figure 10A:
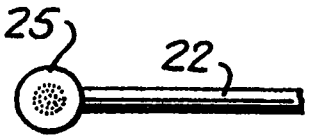
FIGS. 10 and 10*a* show elevational and top views, respectively, of a frame member inner arm post construction with a retainer cap.
Figure 11A:
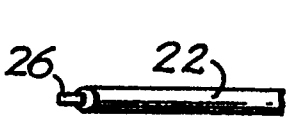
FIGS. 11 and 11*a* show elevational and top views, respectively, of a frame member inner arm post construction with a hook.
Figure 12A:
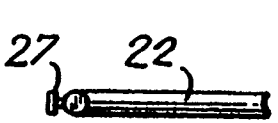
FIGS. 12 and 12*a* show elevational and top views, respectively, of a frame member inner arm post construction with an ear hook.
Figure 9:
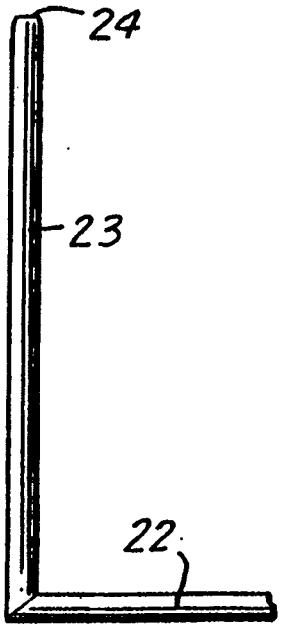
Figure 10:
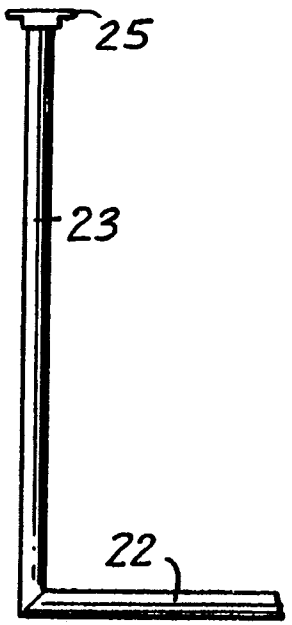
Figure 11:
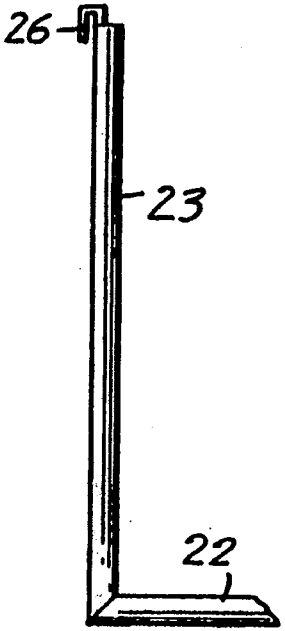
Figure 12:
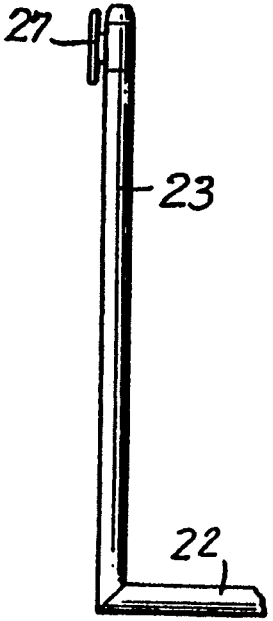

The inner arms of the frame can provide a means for retaining itself in some standard book spines. FIGS. 9–12*a* show various inner arm modifications. FIGS. 9 and 9*a* show a simple post, preferably with a rounded or tapered tip, which would mount frictionally in the cylindrical gap spine of, for example, FIG. 29. FIGS. 10–12*a* show variations that adapt for spiral or tube fittings as a means for retaining the tube more securely while enabling pivotal action. FIGS. 10 and 10*a* show post 23 with a cap 25. This could be a removable element or a rivet. FIGS. 11 and 11*a* shows post 23 with a hook which would fit over the top loop of a spiral, for example. FIGS. 12 and 12*a* shows an ear hook which would be inserted into the gaps between spirals as a means for retaining the post inner arm 23 within a spiral binding.

Figure 15:
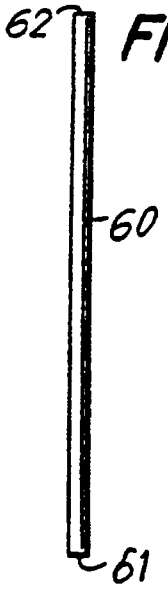
FIGS. 15 and 15*a* show elevational and top views, respectively, of an adapter for inner arm constructed as a hollow tube.
Figure 15A:
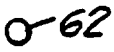
Figure 16:
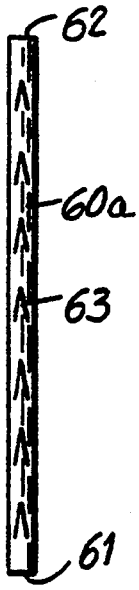
FIGS. 16 and 16*a* show elevational and bottom views, respectively, of a hollow tube adapter with friction spurs for attaching it to a host binding.
Figure 17:
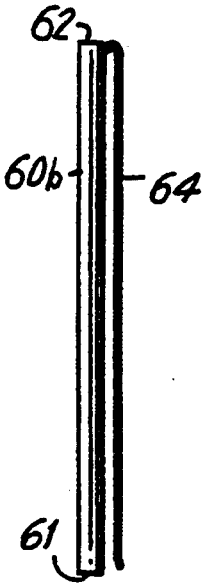
FIGS. 17 and 17*a* show elevational and bottom views, respectively, of a hollow tube adapter with a clip means for attacing it to a host binding.
Figure 18:
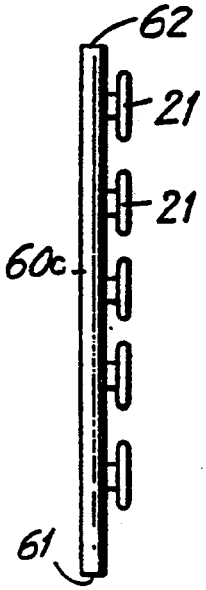
FIGS. 18 and 18*a* show elevational and bottom views, respectively, of a hollow tube adapter fashioned with ear hooks for attaching it to a host binding.
Figure 19:
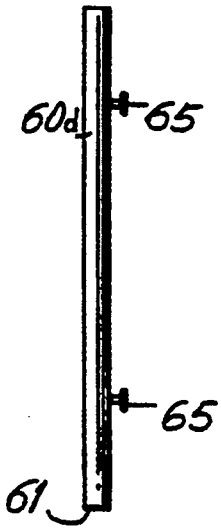
FIGS. 19 and 19*a* show elevational and bottom views respectively of a hollow tube adapter with a rivet mount for attaching it to a host binding.
Figure 16A:
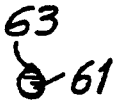
Figure 17A:
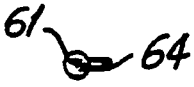
Figure 18A:
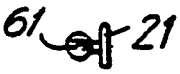
Figure 19A:
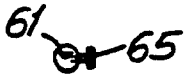

Means for retaining a hollow tube adapter are shown in FIGS. 15–24*a*. FIGS. 15 and 15*a* show the basic hollow tube adapter 60. It can be deployed in most any modification, as shown in FIG. 8. A modification shown in FIGS. 16 and 16*a* which would permit a frictional fit in a cylindrical gap would have spurs 63 along the tube. This figure shows spurs that permit the tube to be slid freely in one direction, but provide abrasion when the tube is slid in the opposite direction. FIGS. 17 and 17*a* shows tube 60 fitted inside clip 64 for mounting in a gap, a spiral, or the like. FIGS. 18 and 18*a* show tube 60 with ear hooks 24 formed along tube 60 as a means for attaching the tube to a spiral. FIGS. 19 and 19*a* shows tube 60 with a rivet attachment 65 for fixing tube 60 to a book spine.

Figure 20:
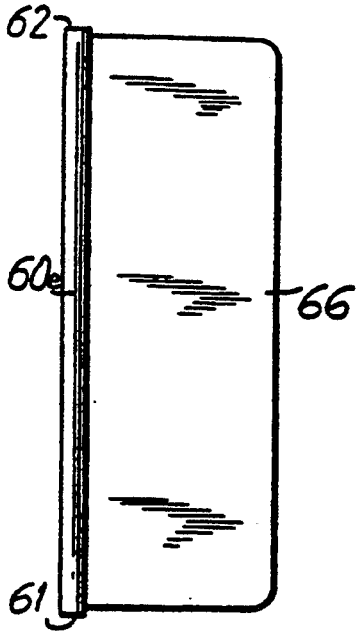
FIGS. 20 and 20*a* show elevational and top views, respectively of a hollow tube adapter with a card mount for attaching it to host binding, with the hollow tube situated on an edge of the card.
Figure 21:
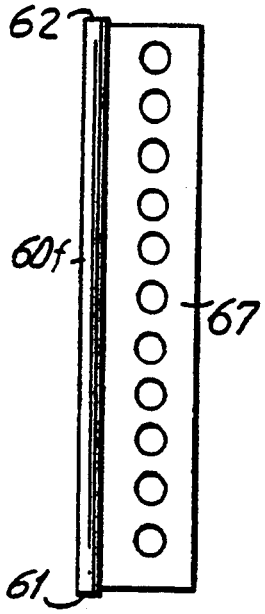
FIGS. 21 and 21*a* show elevational and top views, respectively, of a hollow tube adapter with a multipunched card mount for attaching it to a host binding.
Figure 22:
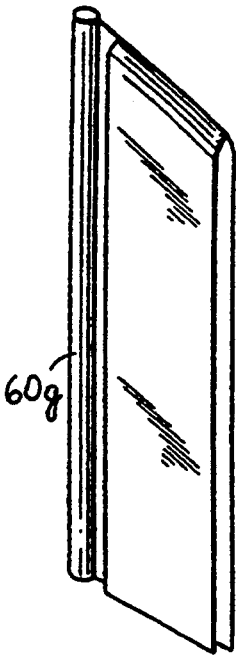
FIG. 22 shows a hollow tube adapter with a broad clip for attaching it to a host book.
Figure 20A:
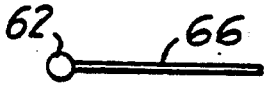
Figure 21A:
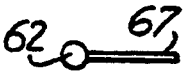
Figure 23:
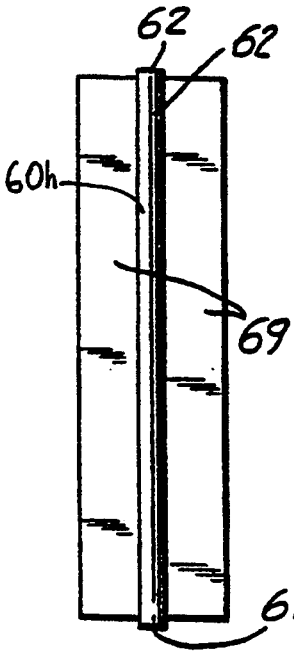
FIGS. 23 and 23*a* show elevational and top views, respectively, of a hollow tube adapter with a card mount for attaching to the host book, with the tube situated in the center of the card.
Figure 23A:
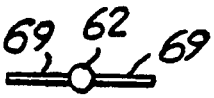
Figure 24:
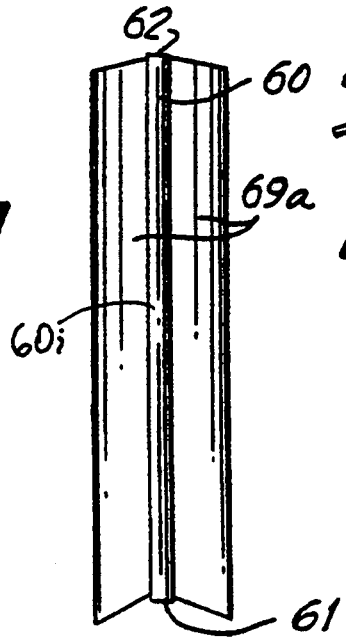
FIGS. 24 and 24*a* show elevational and top views, respectively, of a hollow tube adapter with a card mount, with the tube situated in the center of the card, and where the card folds.
Figure 24A:
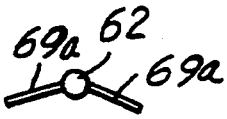

FIGS. 20 and 20*a* shows tube 60 on a card adapter 66 for sliding into a host book cover. FIGS. 21 and 21*a* show a card 67 with multiple holes punched. This adapter would permit the tube to be placed in the inner area of a multi-ring binding. FIGS. 22 and 22*a* show tube 60 with a clamp-style attachment 68. This would allow the tube to be slid onto the back cover of a paperback book or other style of book cover of a firm rectangular shape. FIGS. 23 and 23*a* shows the hollow tube adapter 60 mounted in the center of card 69. This fitting would permit the adapter to fit into a cylindrical gap of the type shown in FIG. 32. FIGS. 24 and 24*a* show tube 60 mounted in a folding card 69*a*. This type of fitting would allow the tube to be deployed in a book cover as a standard feature of the cover. The tube could be on the inside, outside, or formed directly as part of, the folding card.

Figure 56:
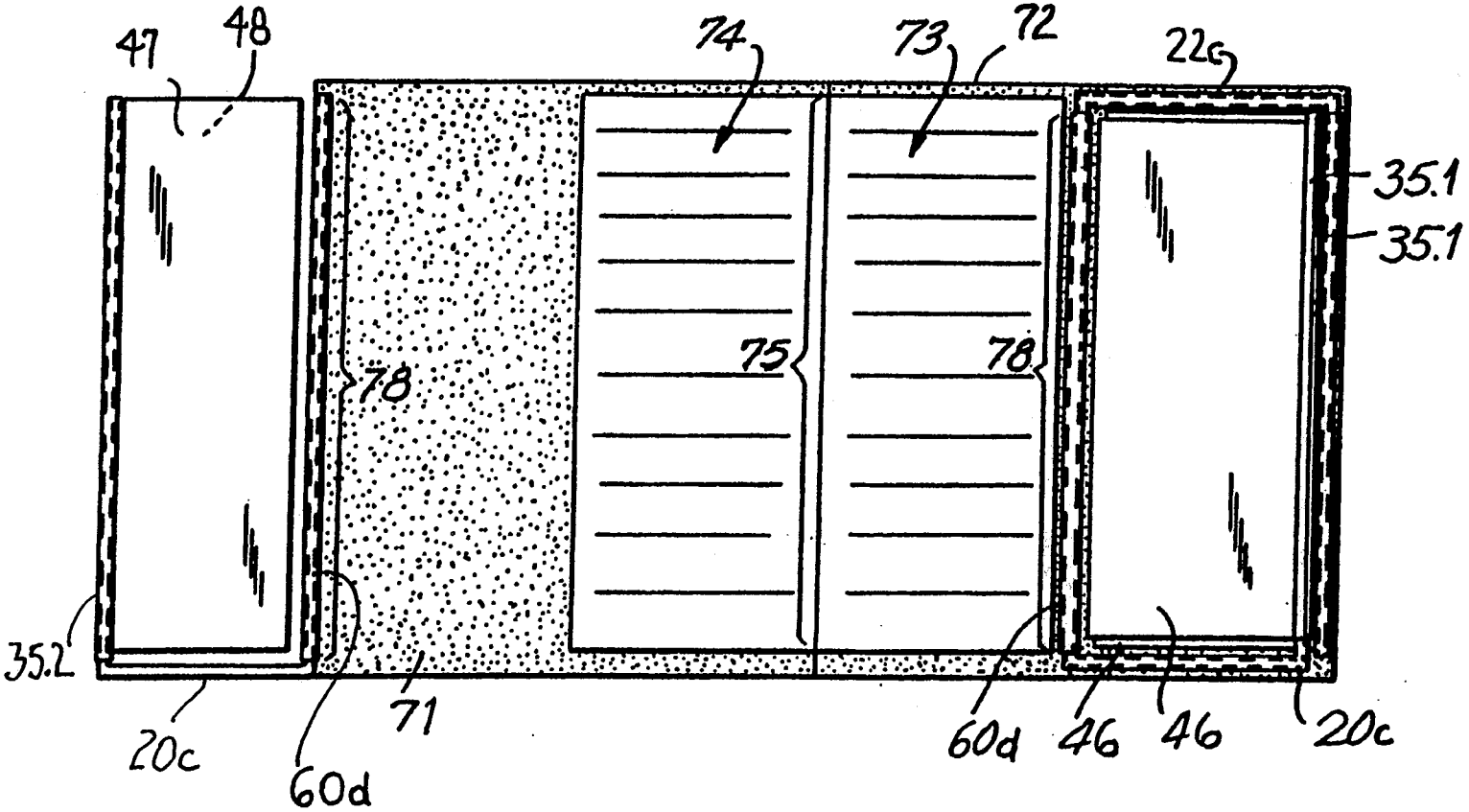
FIG. 56 shows a host book with a dual spine system, having a secondary spine housing a frame set with associated leaf members.

A host book can have primary and secondary spines. FIG. 56 shows a secondary spline 78 positioned equidistantly between the primary spine 75 and the outer edge of the right cover. Additionally, a secondary spine 78 is shown mounted on the edge of the left cover of the host book. A frame 20 is mounted in each secondary spine 78.

For the preferred embodiment, there are additional variations shown in FIGS. 50–54. FIG. 50 shows a way to construct an embodiment 80, with a mounting surface 40 and orientation flap 30 in perspective view. The elements 110, 111 could be made of thin metal strips. Element 112 could be a magnetic element. This would permit the joining of corners a and c or alternatively e and c on a semi-permanent basis. A stiff surface such as a 58 leaf array bottom surface comprised of a stiffened plastic would be attached to the mounting surface by one of various means to implement for example, the leaf array of FIG. 7. Alternatively, a laminate such as a mylar or clear seal film could be placed on the surface directly to stiffen it and as a way to construct an unobstructed mounting surface susceptable to attaching repositionable notes thereon, as detailed later on. Strip 112 would be sandwiched between surfaces 121 and 122, shown in FIG. 52, which form a double walled orientation flap. The double walled construction with adhesive attachment of the walls, as detailed above enables the formation of a stiff orientation flap. FIG. 51 shows one means for forming the leaf, 80, comprising sections 120 and 123 and orientation flap sections 121 and 122 and tube section 35 from one piece of material, with a mounting surface, 40, mounted thereon. The corners b and d are joined in a surface 121, 122 being adhesively connected. Retaining element 112 could be concealed between the surfaces. FIG. 52 shows the leaf of FIG. 51 laid out in a single plane. Hollow tube adapter 35 could also be another type of binding. FIG. 53 shows the addition of surfaces 124, 125 which, along with an arbitrary number of additional surface extensions, could be folded to form a pluralilty of surfaces on top of the mounting surface, as shown in FIG. 54 where the entire leaf is comprised of one piece of material.

The frame can be made of any stiff, inflexible material, with a colored or coated finish to match the host book requirements. The leaf, 50, when made of polyester material such as MYLAR ® or of a woven plastic such as TYVEC ®, can be given a plastic coating on its surface using a material like CLEAR SEAL ®, or may be constructed with a stiffened plastic whose surface offers sufficient adhesion to allow removable adhesive notes to be easily posted and reposted without peeling off. The color of the surfaces can also be selected to match the host or may be color coded to support the application. The surfaces may also be die-cut to enable selective access. They may also contain translucent or opaque pouches for other information handling, or may be shaped to hold an electronic device such as a microcomputer or the like.

The mechanical (hypertext) attachment forms a (hyper) binding system functioning as a list machine which marks any page it is folded into when the book is closed, rests within the perimeter of the cover on either side of the book when the book is open, and allows the pages of the host blank book to sweep past it in either direction when the book is opened and the host blank book pages are turned.

One skilled in the art will appreciate that the present invention can be practiced by other than the embodiments described, which are presented for the purpose of illustration and not of limitation, and the present invention is limited only by the claims which follow.

What is claimed is:

1. A frame attachment for a book, said frame attachment comprising:

a frame member capable of being pivotably attached to said book comprising at least a first arm and a second arm, each arm having a length, said first and said second arms being substantially orthogonal to one another, said first arm further comprising a length adjustment means for allowing the changing of the length of said first arm;

an orientation structure pivotably attached at a first end thereof to an attachment location on said second arm of said frame member; and a mounting surface pivotably attached to said orientation structure at a second end of said orientation structure, said mounting surface having a face and perimeter features; wherein:

said orientation structure enables said mounting surface to be placed in any of two substantially coplanar, non-overlapping and adjacent positions, said positions being on either side of said attachment location, with preservation of orientation of said face and perimeter features of said mounting surface in both positions.

2. An electronic surface attachment, forming a hypermedia structure, for attaching a hypermedia structure to an object, of which it may become a part, said electronic surface attachment comprising at least:

a first section of material having first and second ends and a length between those ends, and having a pivotal fold along a line substantially transverse to said length to define (a) an orientation flap between said first end and said pivotal fold, and (b) a mounting surface portion, between said second end and said pivotal fold;

an electronic device having a surface and perimeter features, and being attached to said mounting surface such that said pivotal fold is located between opposing ends of said electronic device and and away from said opposing ends, wherein said electronic device may pivot freely thereon; and a pivotal retention structure having a first end and a second end, and being pivotally hinged at said first end of said retention structure to said first end of said section of material, for pivotally coupling said electronic surface attachment to an object.

3. A book having front and back covers and a spine, said each of said covers having perimeter features including at least one free cover edge, said covers having an attachment system thereon comprising a book coupling structure configuration, said coupling structure configuration comprising a plurality of coupling structures at least one of said coupling structures being at said book spine, for receiving leaf pages therein, and one or more additional coupling structures, each one or more additonal coupling structures comprising a pivotal hinge portion for receiving a pivotal attachment structure therein, said each of said additional pivotal hinge portions being located away from said spine; and one or more attachments, said attachments being coupled to said book at one or more of said book coupling structures, each said attachments selected from the group consisting of:

(a) a frame attachment comprising:

a frame member;

a leaf member having a plurality of faces and perimeter features;

first binding means for binding said leaf member to said frame member;

second binding means for binding said frame to said book at one of said coupling structures; and orientation maintaining means for allowing preservation of orientation of said faces and said perimeter features of said leaf relative to said book; such that:

said frame member, said leaf member and said first binding means define a frame/leaf pair;

when said frame member is bound to said book at said coupling structure, said leaf member may be moved about said frame, and said frame moved about said coupling structure, such that said leaf member can be positioned in any one of a plurality of locations, at least two of said locations being non-overlapping and coplanar, each of said two locations being substantially adjacent to at least one of the other said two locations, the same face of said leaf member retaining its face and perimeter feature orientations in said two adjacent ones of said two locations; and (b) a frame set attachment comprising:

a plurality of frame attachments, each said frame attachment comprising:

a frame member, a leaf member having a plurality of faces and perimeter features, and first binding means for binding said leaf member to said frame member, thereby defining a frame/leaf pair;

second binding means for binding a plurality of frame attachments into a frame set; and ordinal positioning enabling means for enabling the ordinal positioning of frame/leaf pairs of a frame set; such that:

when said frame/leaf pair is bound to said frame set and said frame set bound to said book at said coupling structure, said leaf may be moved about said frame, and said frame moved about said frame set and said frame set moved about said coupling structure, such that said leaf can be positioned in any one of a plurality of locations, each frame/leaf pair being capable of moving substantially freely past any other frame/leaf pair in such a manner that any frame/leaf pair may be placed in any ordinal position relative to any other frame/leaf pair.

4. A book having front and back covers and a spine, said each of said covers having perimeter features including at least one free cover edge, said covers having an attachment system thereon comprising a book coupling structure configuration, said coupling structure configuration comprising a plurality of coupling structures at least one of said coupling structures being at said book spine, for receiving leaf pages therein, and one or more additional coupling structures, each one or more additonal coupling structures comprising a pivotal hinge portion for receiving a pivotal attachment structure therein; and one or more attachments, said attachments being coupled to said book at one or more of said book coupling structures, each said attachments selected from the group consisting of:

(a) a frame attachment comprising:

a frame member;

a leaf member having a plurality of faces and perimeter features;

first binding means for binding said leaf member to said frame member;

second binding means for binding said frame to said book at one of said coupling structures; and orientation maintaining means for allowing preservation of orientation of said faces and said perimeter features of said leaf relative to said book; such that:

said frame member, said leaf member and said first binding means define a frame/leaf pair;

when said frame member is bound to said book at said coupling structure, said leaf member may be moved about said frame, and said frame moved about said coupling structure, such that said leaf member can be positioned in any one of a plurality of locations, at least two of said locations being non-overlapping and coplanar, each of said two locations being substantially adjacent to at least one of the other said two locations, the same face of said leaf member retaining its face and perimeter feature orientations in said two adjacent ones of said two locations;

(b) a frame set attachment comprising:

a plurality of frame attachments, each said frame attachment comprising:

a frame member, a leaf member having a plurality of faces and perimeter features, and first binding means for binding said leaf member to said frame member, thereby defining a frame/leaf pair;

second binding means for binding a plurality of frame attachments into a frame set; and ordinal positioning enabling means for enabling the ordinal positioning of frame/leaf pairs of a frame set; such that:

when said frame/leaf pair is bound to said frame set and said frame set bound to said book at said coupling structure, said leaf may be moved about said frame, and said frame moved about said frame set and said frame set moved about said coupling structure, such that said leaf can be positioned in any one of a plurality of locations, each frame/leaf pair being capable of moving substantially freely past any other frame/leaf pair in such a manner that any frame/leaf pair may be placed in any ordinal position relative to any other frame/leaf pair; and (c) a frame attachment comprising:

a frame member;

a leaf member having a plurality of faces and perimeter features; and an orientation member;

first binding means for binding said leaf member to said orientation member;

second binding means for binding said orientation member to said frame member;

third binding means for binding said frame to said host object at one of said coupling structures;

said orientation maintaining means for allowing preservation of orientation of said faces and said perimeter features relative to said host object; such that:

said frame member, said leaf member, said first binding means, and second binding means define a frame/leaf pair;

when said frame member is bound to said host object at said coupling structure, said leaf member may be moved about said frame, and said frame moved about said coupling structure, such that said leaf member can be positioned in any one of a plurality of locations, at least four of said locations being non-overlapping and coplanar, each of said four locations being substantially adjacent to at least one of the other said four locations, the same face of said leaf member retaining its face and perimeter feature orientations in at least two adjacent ones of said four locations.

5. The combination comprising:

a book having a spine and front and back covers, said covers defining a first perimeter foot print of said book when said book is open and a second perimeter footprint when said book is closed;

a composite coupling structure supported by said book at said book spine comprising a pivotal hinge portion for receiving a pivotal attachment structure therein and a leaf binding means for attaching leaf pages thereto;

a plurality of leaf pages attached to said leaf binding means;

at least one frame member providing a pivotal attachment structure, pivotably coupled to said book at said composite coupling structure pivotal hinge portion;

an orientation structure pivotably attached at a first part thereof to an attachment location on said at least one frame member; and a mounting surface having a face and perimeter features pivotably attached to said orientation structure at a second part of said orientation structure; wherein:

said orientation structure enables said mounting surface to be placed in any two substantially coplanar, non-overlapping, and adjacent positions, said positions being on either side of said attachment location on said frame member, with preservation of orientation of said face and perimenter features of said mounting surface in both positions, and wherein:

said pivotal coupling of said frame member to said book enables said surface to be positioned in two additional locations, with all four locations being substantially coplanar, non-overlapping, and adjacent, one to the next, with said mounting surface retaining it's face and perimeter feature orientations in all four of said four locations, and wherein:

at least one of said four positions can lay substantially within the perimeter footprint defined by said covers of said book when said book is closed, at least two of said four positions can lay substantially within the perimeter foot print of said book when said book is open, and at least two positions can lay subtsantially outside said perimeter footprint defined by said covers of said book when said book is open, and wherein:

said mounting surface may additionally be placed between any of said plurality of leaf pages when said book is opened or closed, where said each of said plurality of leaf pages may be turned past said mounting surface at will without obstruction by said mounting surface or said leaf pages, and further where said mounting surface may be placed on the outside of said book resting on a cover thereof.

6. A leaf attachment for an object, of which it may become a part, said leaf attachment comprising at least:

a sheet of material having first and second ends and a length between those ends, wherein:

said material includes a first fold transverse to said length between said first and second ends;

said material includes second and third folds substantially parallel to and equidistant from said first fold;

said material is folded together at said first fold, said material between said first fold and said second fold and said material between first fold and said third fold having means therefore for being attached one to the other to form an orientation support member; and said sheet of material is folded apart at said second and third folds to form a pivotally hinged mounting surface for receiving a surface, said surface being comprised of said material between said first end, said second fold, said third fold, and said second end.

7. The leaf attachment of claim 6 wherein said first fold substantially bisects said sheet of material.

8. The leaf attachment of claim 6 wherein said pivotally hinged mounting surface has a second substantially stiff surface mounted thereon.

9. The leaf attachment of claim 8 wherein said leaf attachment further comprises means for semi-permanently joining said pivotally hinged mounting surface to said orientation support member when said pivotally hinged mounting surface is folded into at least one position where said pivotally hinged mounting surface and said orientation support member are substantially coplanar one atop the other.

10. A leaf attachment comprising at least a retaining structure having first and second ends, an orientation member having first and second ends, and a mounting surface having first and second ends, wherein said second end of said orientation member is pivotally hinged to said mounting surface between and away from said opposing ends of said mounting surface, and said first end of said orientation member is pivotally hinged to said second end of said retention structure, and wherein said retaining structure, said orientation member, and said mounting surface are made from flexible material, and at least said structure comprising said mounting surface and said orientation member is made of one piece of said flexible material, where said hinge effect of said pivotal hinges is created soiey by the inherent flexibility of the material itself.

* * * * *